US010766756B2

(12) United States Patent
Gatipon et al.

(10) Patent No.: US 10,766,756 B2
(45) Date of Patent: Sep. 8, 2020

(54) BEVERAGE NOZZLE WITH MIXING CORE

(71) Applicant: THE COCA-COLA COMPANY, Atlanta, GA (US)

(72) Inventors: Shaun B. Gatipon, Kennesaw, GA (US); Alejandro J. Santamaria, Suwanee, GA (US); Joshua B. Wilson, Stockbridge, GA (US); Robert B. Brownell, Jr., Decatur, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 16/281,624

(22) Filed: Feb. 21, 2019

(65) Prior Publication Data

US 2019/0194009 A1 Jun. 27, 2019

Related U.S. Application Data

(62) Division of application No. 15/118,219, filed as application No. PCT/US2015/016257 on Feb. 18, 2015, now Pat. No. 10,266,382.

(Continued)

(51) Int. Cl.
*B67D 1/00* (2006.01)
*B01F 5/06* (2006.01)

(Continued)

(52) U.S. Cl.
CPC ..... *B67D 1/0048* (2013.01); *B01F 3/0861* (2013.01); *B01F 5/0604* (2013.01);

(Continued)

(58) Field of Classification Search
CPC .... B01F 5/0604; B01F 5/0606; B01F 3/0861; B67D 1/0044; B67D 1/0048;

(Continued)

(56) References Cited

U.S. PATENT DOCUMENTS 3,460,717 A * 8/1969 Thomas ..... A23G 9/282 222/129.1
4,316,673 A * 2/1982 Speer ..... B01F 5/0609 366/337

(Continued)

*Primary Examiner* — Charles Cheyney
(74) *Attorney, Agent, or Firm* — Eversheds Sutherland (US) LLP

(57) ABSTRACT

The disclosure is directed to a beverage nozzle for mixing at least a first beverage ingredient and a second beverage ingredient into a homogeneous mixture. The beverage nozzle comprising a housing comprising a first portion and a second portion and a first inlet in fluid communication with the housing. The first inlet is configured to provide the first beverage ingredient to the housing. The beverage nozzle also includes a second inlet in fluid communication with the housing. The second inlet is configured to provide the second beverage ingredient to the housing. In addition, the beverage nozzle includes a mixing core disposed within the housing. The mixing core is configured to mix the first beverage ingredient and the second beverage ingredient into the homogeneous mixture. Further, the beverage nozzle includes an outlet disposed about the housing, wherein the homogeneous mixture exits the housing by way of the outlet.

18 Claims, 30 Drawing Sheets

Related U.S. Application Data

(60) Provisional application No. 61/941,113, filed on Feb. 18, 2014.

(51) Int. Cl.
*B01F 13/00* (2006.01)
*B01F 3/08* (2006.01)
*B67D 1/10* (2006.01)

(52) U.S. Cl.
CPC ..... *B01F 5/0606* (2013.01); *B01F 13/0022* (2013.01); *B67D 1/0021* (2013.01); *B67D 1/0044* (2013.01); *B67D 1/0081* (2013.01); *B67D 1/108* (2013.01); *B01F 2215/0022* (2013.01); *B67D 2001/0095* (2013.01)

(58) Field of Classification Search
CPC .... B67D 1/0046; B67D 1/005; B67D 1/1231; B67D 1/0021; B67D 1/0079; B67D 1/0037; B67D 1/108
USPC ..... 222/132, 129.1, 145.5, 459, 145.6, 214, 222/129.3, 145.1, 133, 136
See application file for complete search history.

(56) References Cited

U.S. PATENT DOCUMENTS

| | | | | | |
|---|---|---|---|---|---|
| 4,552,286 | A * | 11/1985 | Kuckens | B67D 1/0043 | 222/1 |
| 4,753,370 | A * | 6/1988 | Rudick | B67D 1/0051 | 222/105 |
| 4,907,725 | A * | 3/1990 | Durham | B67D 1/0044 | 138/42 |
| 5,093,058 | A * | 3/1992 | Harmon | B01F 3/0807 | 239/106 |
| 5,383,581 | A * | 1/1995 | LeMarbe | B67D 1/0027 | 222/129.1 |
| 5,909,959 | A * | 6/1999 | Gerich | B01F 5/0615 | 222/459 |
| 6,808,091 | B2 * | 10/2004 | Njaastad | B67D 1/0081 | 222/129.1 |
| 7,036,687 | B1 * | 5/2006 | Lowe | A47J 31/401 | 222/129.1 |
| 8,591,099 | B2 * | 11/2013 | Reddy | B67D 1/0021 | 366/167.1 |
| 10,266,382 | B2 * | 4/2019 | Gatipon | B67D 1/0048 | |
| 2009/0211456 | A1 * | 8/2009 | De Graaff | A47J 31/405 | 99/279 |
| 2010/0147414 | A1 * | 6/2010 | Nighy | B65B 3/045 | 141/10 |

* cited by examiner

BEVERAGE NOZZLE WITH MIXING CORE

CROSS-REFERENCE TO RELATED APPLICATIONS

The disclosure claims priority to, the benefit of, and is a divisional application of U.S. patent application Ser. No. 15/118,219, filed Aug. 11, 2016 which is a national stage entry application under 35 U.S.C. § 371 of PCT/US/2015/016257, filed Feb. 18, 2015, which claims priority to and the benefit of U.S. provisional patent application No. 61/941,113, filed Feb. 18, 2014, which are all hereby incorporated by reference herein in their entireties.

FIELD OF THE DISCLOSURE

The disclosure generally relates to beverage nozzles and more particularly relates to systems and methods for mixing various beverage ingredients.

BACKGROUND

Typical beverage nozzles are limited to mixing a single type of beverage. That is, depending on the beverage, specific beverage nozzles may be used to ensure adequate mixing of the beverage ingredients that comprise the beverage. For example, some beverage nozzles may be designed to mix juice ingredients, while other beverage nozzles may work better for tea or soda ingredients. In this manner, a beverage dispenser may be limited in the beverages it can dispense due to the limited mixing capabilities of its beverage nozzles.

SUMMARY

Some or all of the above needs and/or problems may be addressed by certain embodiments of the beverage nozzle disclosed herein. For example, in an embodiment, a beverage nozzle for mixing at least a first beverage ingredient and a second beverage ingredient into a homogeneous mixture is disclosed herein. The beverage nozzle may include a housing having a first portion and a second portion. A first inlet may be in fluid communication with the housing. The first inlet may be configured to provide the first beverage ingredient to the housing. A second inlet may be in fluid communication with the housing. The second inlet may be configured to provide the second beverage ingredient to the housing. The beverage nozzle also may include a mixing core disposed within the housing. The mixing core may be configured to mix the first beverage ingredient and the second beverage ingredient into the homogeneous mixture. An outlet may be disposed about the housing. The homogeneous mixture may exit the housing by way of the outlet.

Other features and aspects of the beverage nozzle will be apparent or will become apparent to one with skill in the art upon examination of the following figures and the detailed description. All other features and aspects, as well as other systems, methods, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Described below are example embodiments of one or more beverage nozzles (as well as individual components of the beverage nozzles). The beverage nozzles may be used to mix various beverage ingredients into a homogeneous mixture. The beverage nozzles may be used in any suitable application. The beverage nozzles may provide the technical effect and/or solution of enabling a wide variety of beverage ingredients to be mixed together. Moreover, the beverage nozzles may eliminate or reduce contamination of the unmixed beverage ingredients.

These and other embodiments of the beverage nozzles will be described in more detail through reference to the accompanying drawings. The techniques described above and below may be implemented in a number of ways and in a number of contexts. Several example implementations and contexts are provided with reference to the following figures, as described below in more detail. However, the following implementations and contexts are but a few of many.

Figure 1:
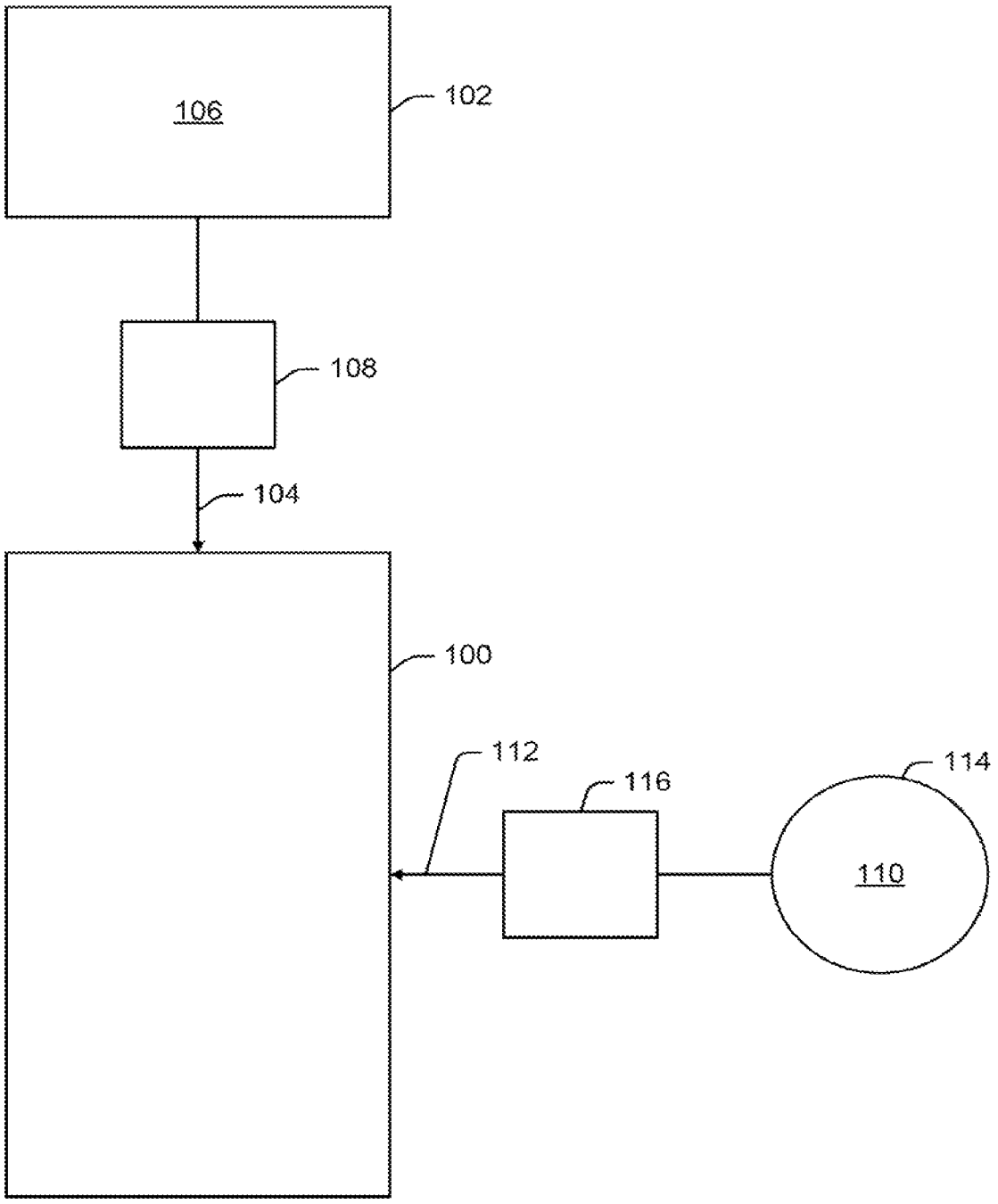
FIG. 1 schematically depicts a beverage dispensing system n accordance with one or more embodiments of the disclosure.
Figure 2:
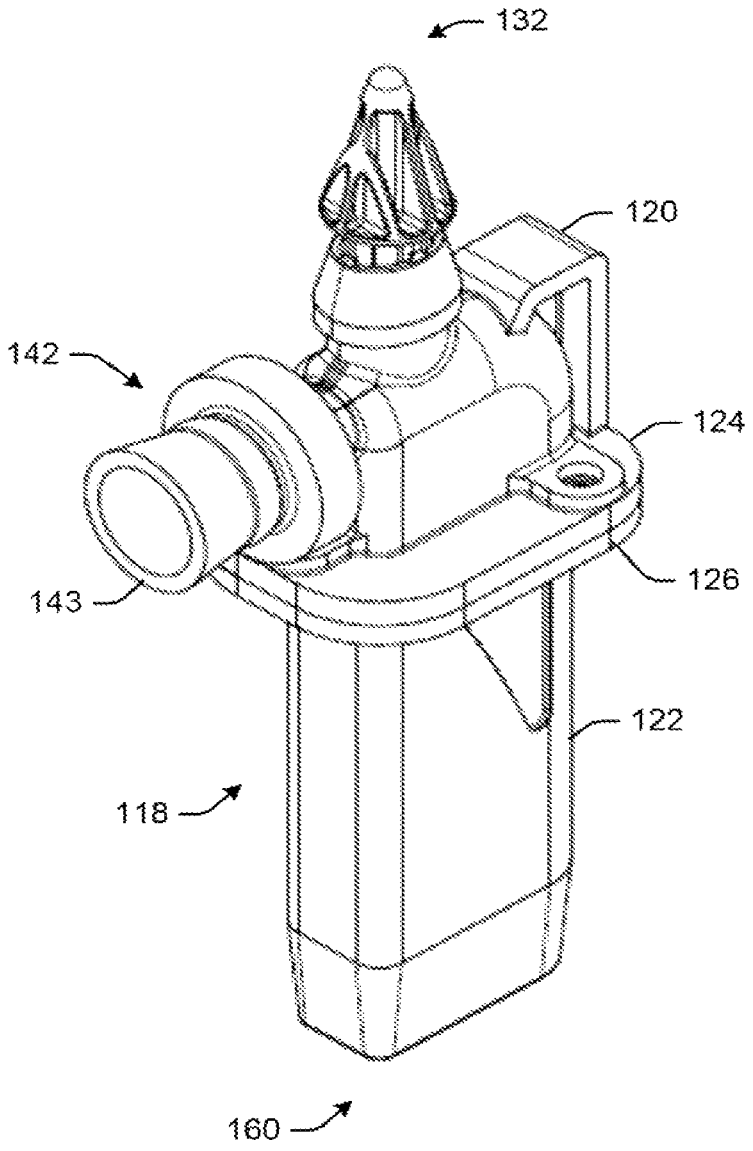
FIG. 2 depicts a beverage nozzle in accordance with one or more embodiments of the disclosure.
Figure 3:
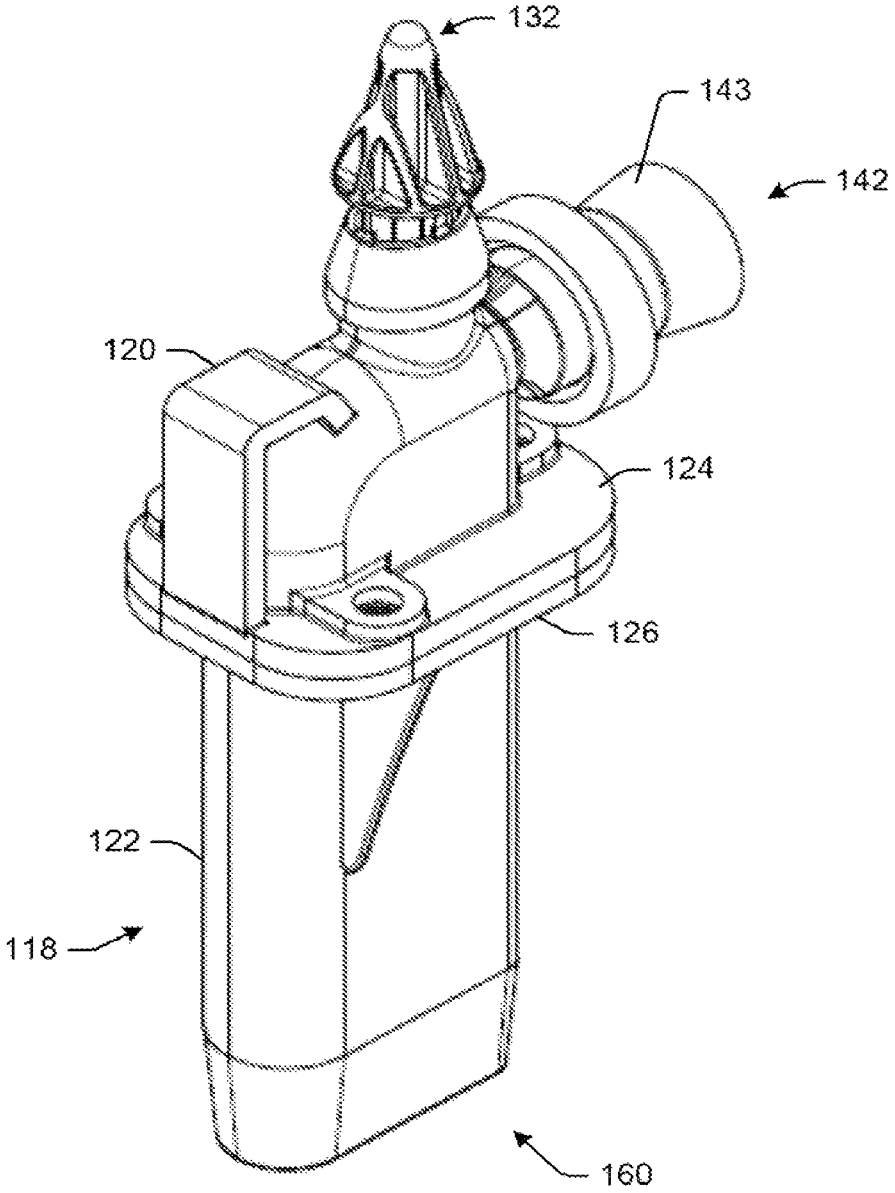
FIG. 3 depicts a beverage nozzle in accordance with one or more embodiments of the disclosure.

As depicted in FIG. 1, a beverage nozzle 100 may be in fluid communication with a container 102 (such as a bag-in-box container or the like). The beverage nozzle 100 may be in communication with the container 102 by way of a first fluid conduit 104. A first beverage ingredient 106 may be housed within the container 102. By way of example, the first beverage ingredient 106 may be a concentrate, a syrup, a slurry, a carbonated beverage concentrate, a juice or juice mixture, a flavor component, h pulp juice, a high viscosity fluid, a vitamin concentrate, enhanced water, a low viscosity fluid, a product containing particulate, a dairy product, a yogurt, water, or any combination or derivative thereof. Other suitable beverage ingredients may be used herein. The first beverage ingredient 106 may be any suitable beverage ingredient or combination of beverage ingredients.

In some instances, a peristaltic pump 108 may be disposed about the first fluid conduit 104 between the beverage nozzle 100 and the container 102. In this manner, the peristaltic pump 108 may be configured to pump the first beverage ingredient 106 within the container 102 to the beverage nozzle 100. Any pump or pump-like device may be used to transfer the first beverage ingredient 106 from the container 102 to the beverage nozzle 100. More than one pump may be used.

The beverage nozzle 100 may be in fluid communication with a second beverage ingredient 110 by way of a second fluid conduit 112. In some instances, the second beverage ingredient 110 may be water. In this manner, the beverage nozzle 100 may be in fluid communication with a water source 114. In some instances, a flow valve 116 or the like may be disposed about the second fluid conduit 112 to control the flow of water to the beverage nozzle 100. The second beverage ingredient 110 may be any beverage ingredient, including those described above with reference to the first beverage ingredient 106.

Two beverage ingredients are illustrated for clarity. However, one or more additional beverage ingredients may be in fluid communication with the beverage nozzle 100. For example, one or more additional fluid conduits may provide the beverage nozzle 100 with one or more flavor components, vitamins, and/or additional beverage ingredients, including those described above.

Figure 4:
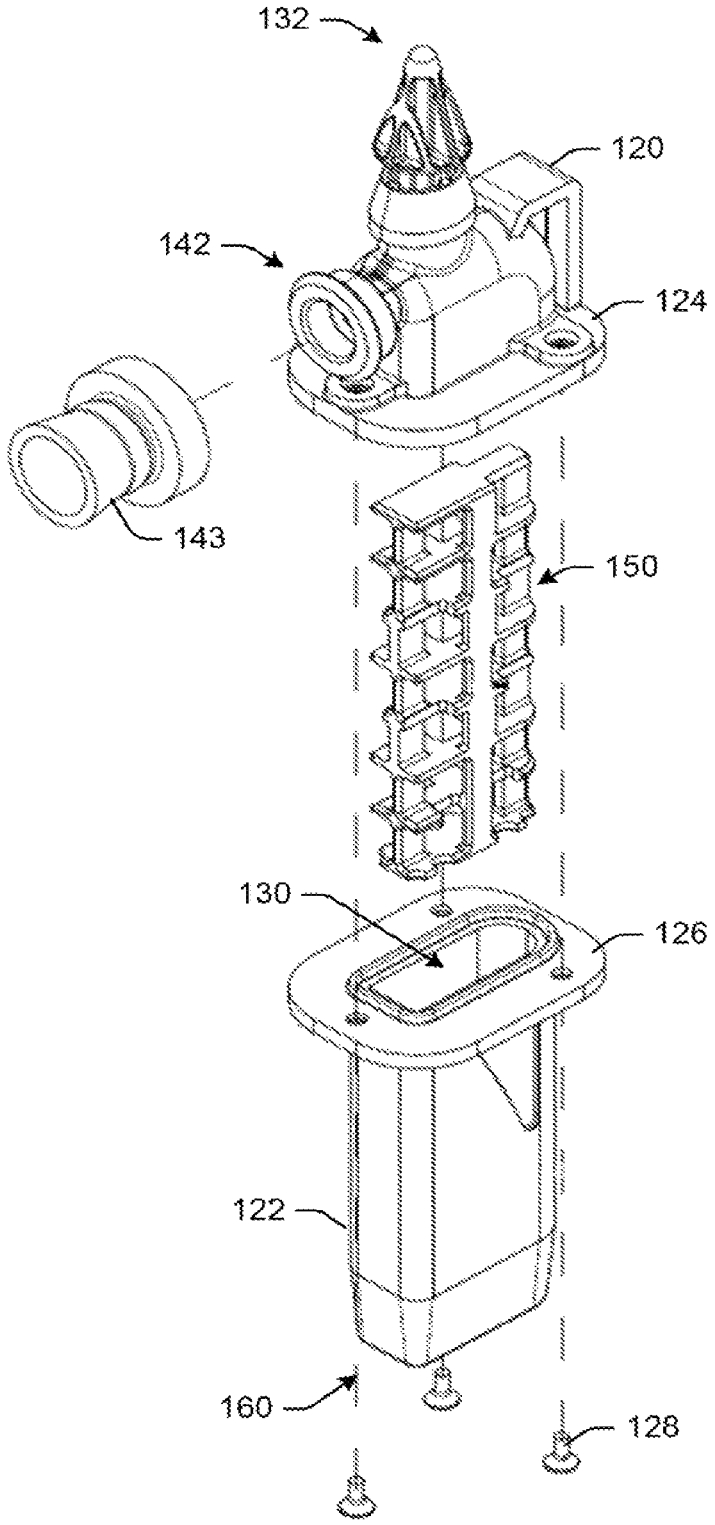
FIG. 4 depicts an exploded view of a beverage nozzle in accordance with one or more embodiments of the disclosure.
Figure 5:
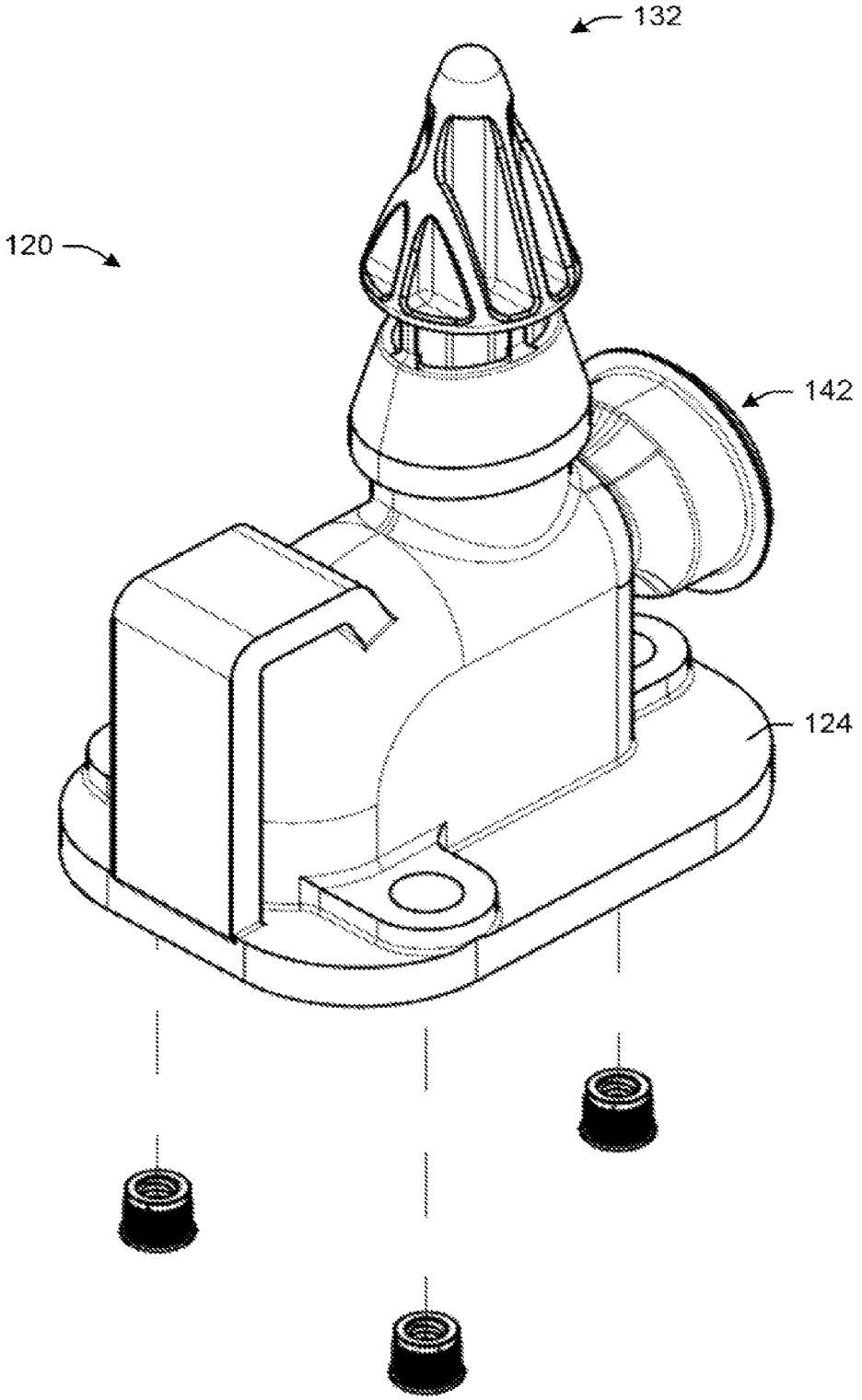
FIG. 5 depicts an upper portion of a beverage nozzle in accordance with one or more embodiments of the disclosure.

FIGS. 2-22 depict the beverage nozzle 100 (as well as individual components of the beverage nozzle 100) in greater detail. The beverage nozzle 100 may include a housing 118 having an upper portion 120 and a lower portion 122. The upper portion 120 is depicted in FIGS. 2-9, and the lower portion is depicted in FIGS. 2-4 and 10-14. In some instances, the upper portion 120 and the lower portion 122 may form a single unitary structure. In other instances, the upper portion 120 and the lower portion 122 may be attached and detached from each other. For example, as depicted in FIG. 4, the upper portion 120 may include an upper flange 124 and the lower portion 122 may include a lower flange 126. In some instances, the upper flange 124 and the lower flange 126 may be secured together by way of one or more screws 128. In other instances, the upper portion 120 and the lower portion 122 may be secured together by way of a snap-on mechanism. Any suitable attachment mechanism that enables the upper portion 120 and the lower portion 122 to be separated and/or attached may be used.

In some instances, the housing 118 may define an elongated internal chamber 130. For example, the lower portion 122 may define the elongated internal chamber 130. In some instances, the lower portion 122 and the upper portion 120 may define the elongated internal chamber 130.

The beverage nozzle 100 may include a first inlet 132. The first inlet 132 may be in fluid communication with the elongated internal chamber 130 of the housing 118 by way of one or more openings in the house 118. In some instances, the first inlet 132 may be disposed about the upper portion 120. The first inlet 132 may be disposed at any location about the housing 118. The first inlet 132 may be configured to provide the first beverage ingredient 106 to the housing 118. For example, the first inlet 132 may be in fluid communication with the container 102 by way of the first fluid conduit 104.

Figure 6:
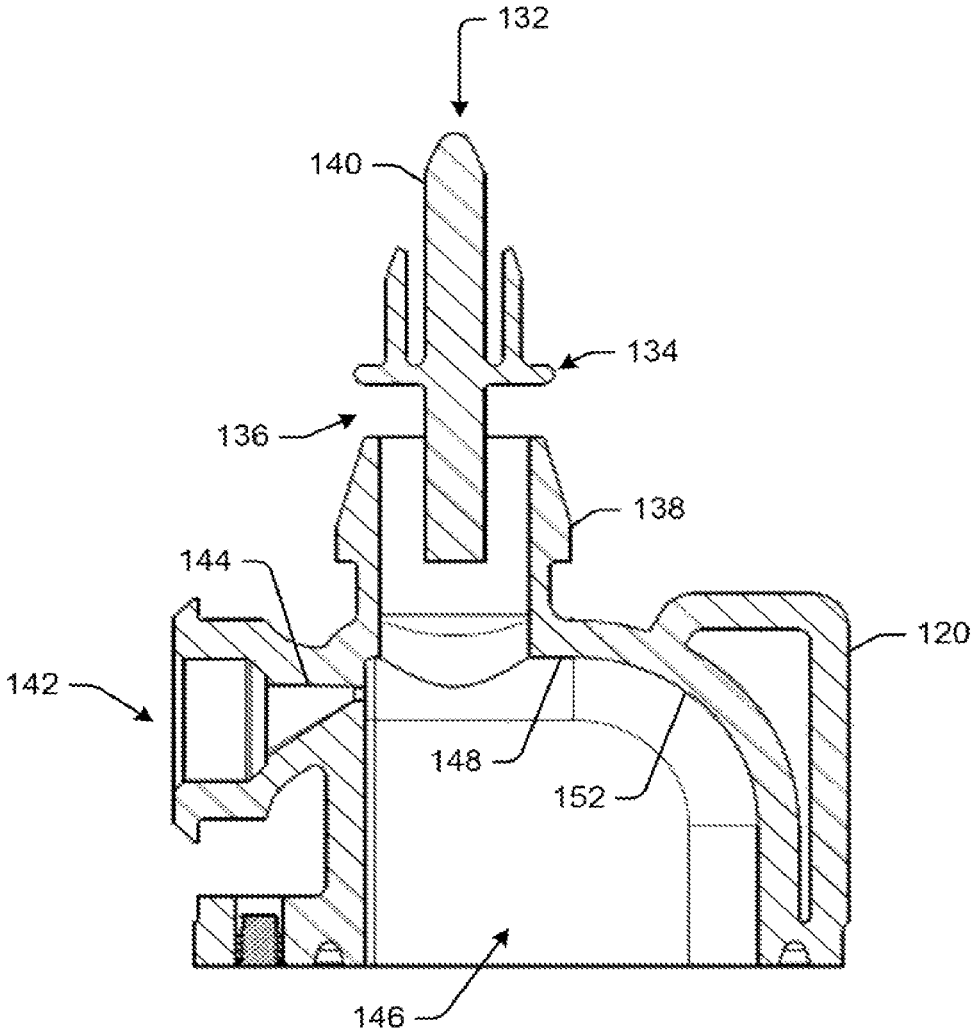
FIG. 6 depicts cross-sectional view of an upper portion of a beverage nozzle in accordance with one or more embodiments of the disclosure.
Figure 7:
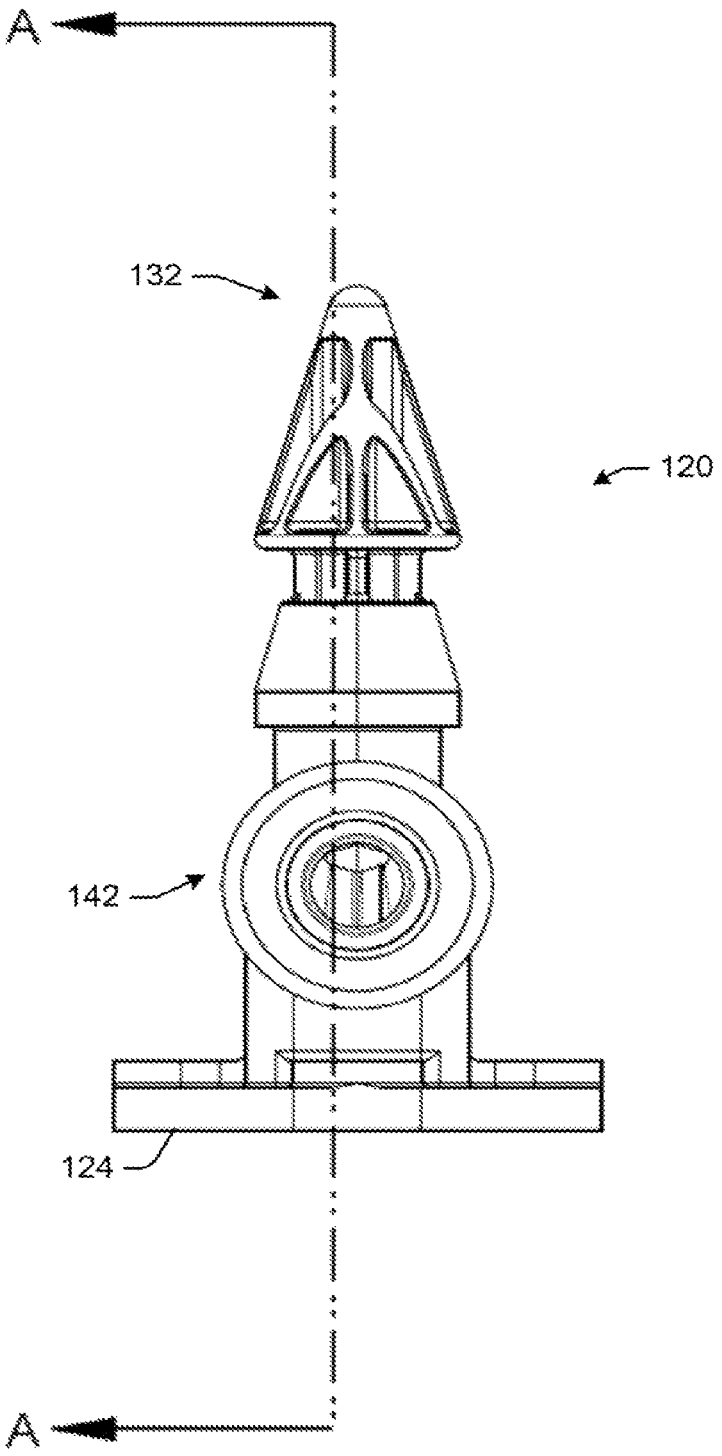
FIG. 7 depicts an upper portion of a beverage nozzle in accordance with one or more embodiments of the disclosure.
Figure 8:
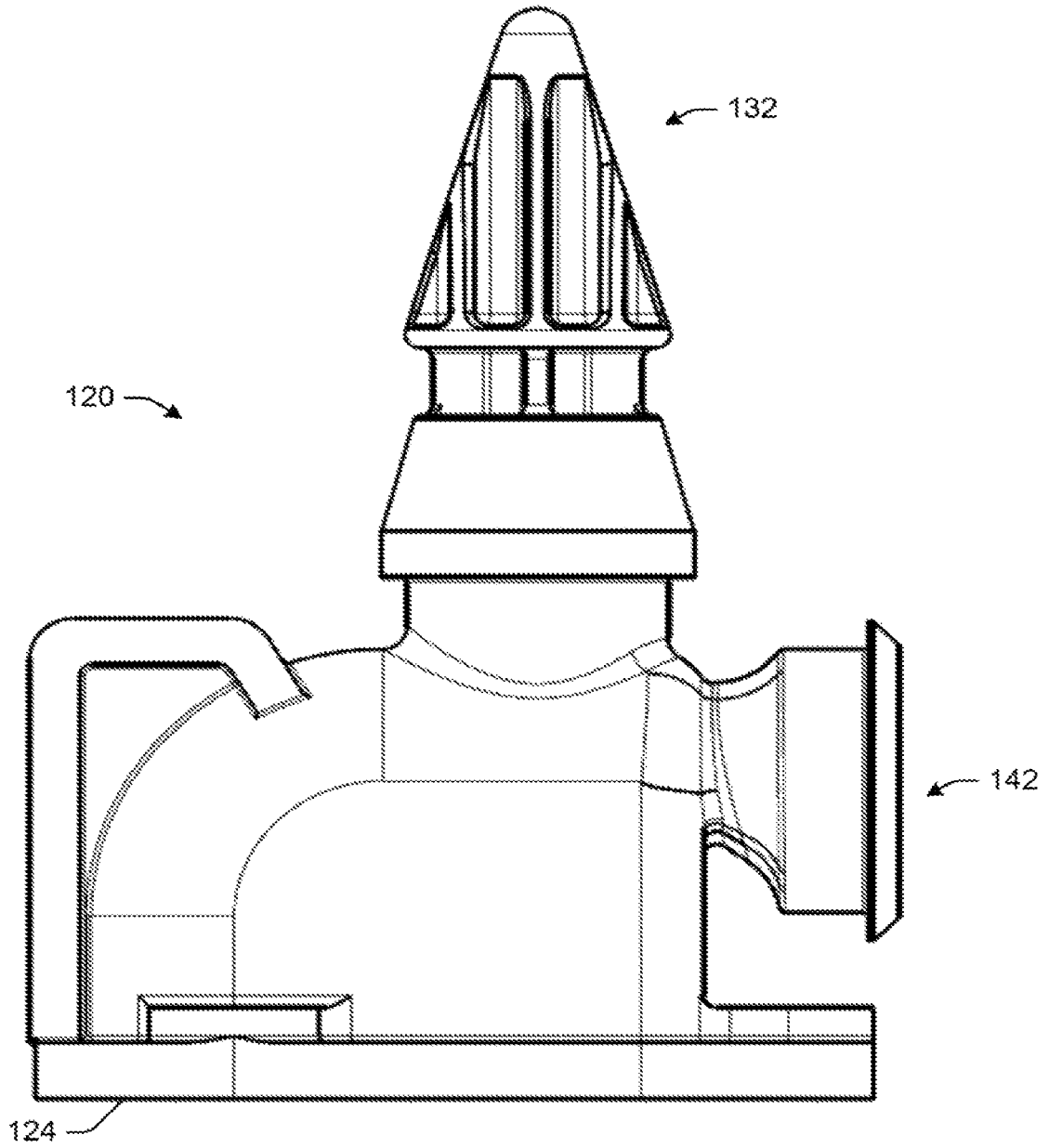
FIG. 8 depicts an upper portion of a beverage nozzle in accordance with one or more embodiments of the disclosure.
Figure 9:
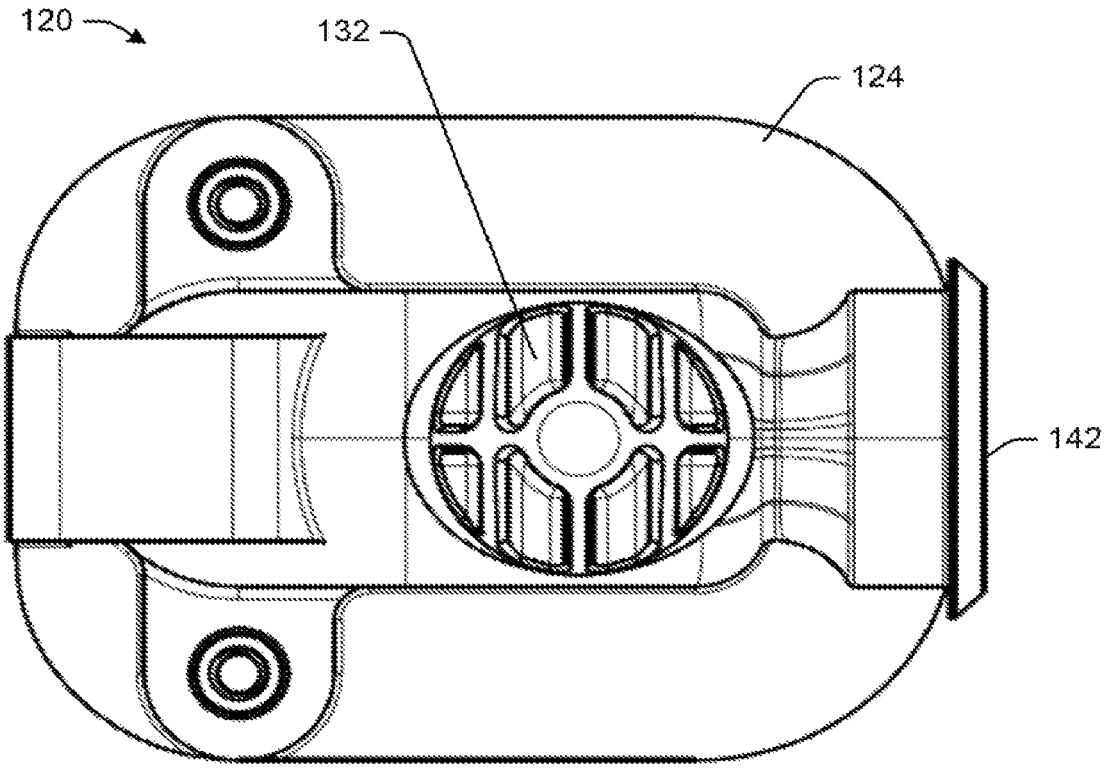
FIG. 9 depicts an upper portion of a beverage nozzle in accordance with one or more embodiments of the disclosure.
Figure 10:
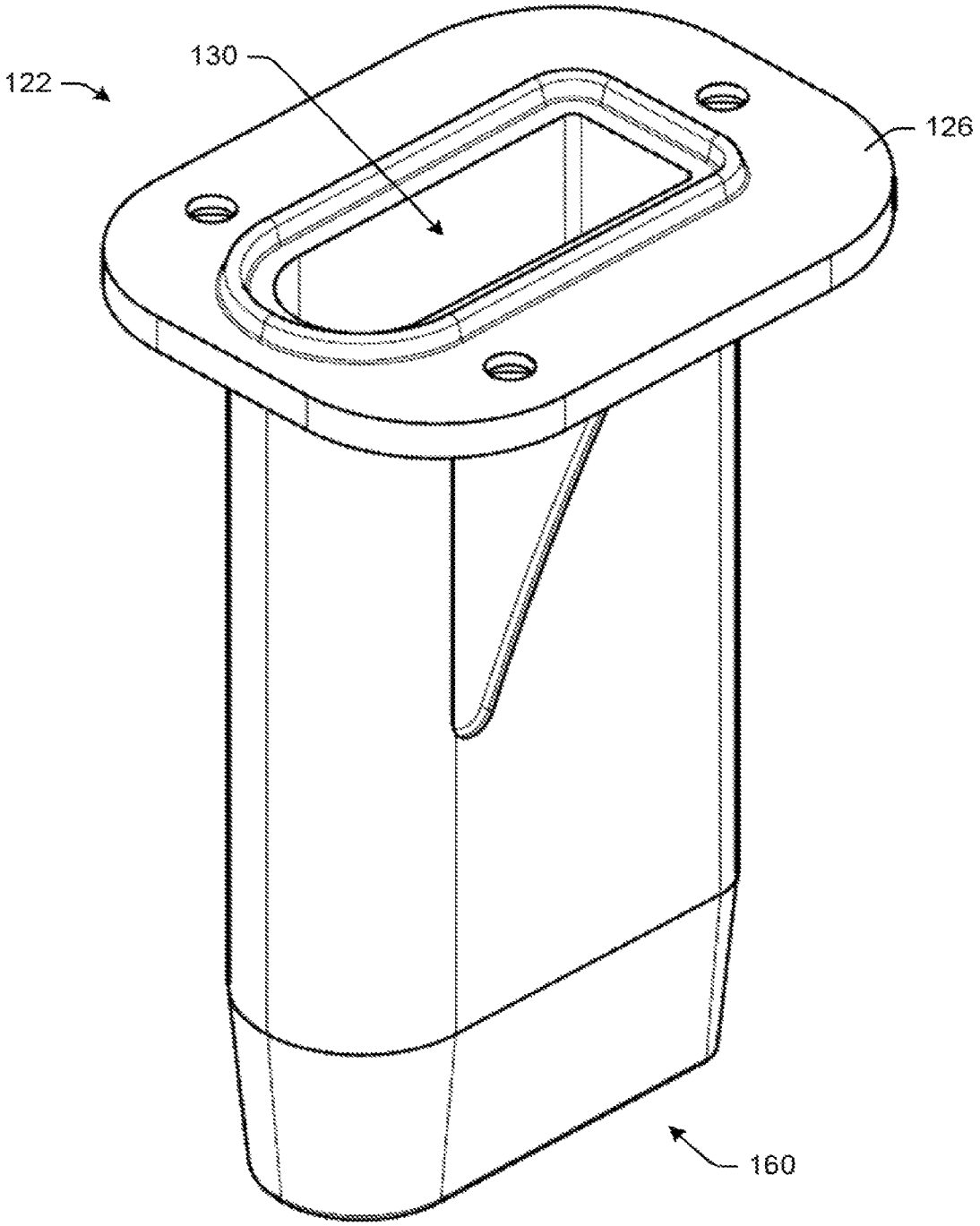
FIG. 10 depicts a lower portion of a beverage nozzle in accordance with one or more embodiments of the disclosure.

As depicted in FIG. 6, in some instances, in order to prevent backflow into the container 102, the first inlet 132 may be a check valve 134. For example, the first inlet 132 may include an opening 136 disposed between a barbed portion 138 and a head portion 140. The head portion 140 may be inserted into the first fluid conduit 104 such that the first fluid conduit 104 passes over the barbed portion 138. An outer diameter of the barbed portion 138 may be greater than an inner diameter of the first fluid conduit 104. In this manner, the first fluid conduit 104 may be a flexible material that expands over the barded portion 138 and is secured in place.

When the peristaltic pump 108 pumps the first beverage ingredient 106, the inner diameter of the first fluid conduit 104 may be configured to expand about the head portion 140 to enable the first beverage ingredient 106 to pass into the opening 136. When the peristaltic pump 108 stops pumping the first beverage ingredient 106, the inner diameter of the first fluid conduit 104 may be configured to contract about the head portion 140 to create a seal which prevents backflow. Other types of check valve configurations are possible, including, but not limited to, duckbill valves, ball valves, etc. Any valve configuration capable of preventing backflow can be used herein. Preventing backflow to the container 102 may maintain the aseptic nature of the first beverage ingredient 106 disposed within the container 102. In some instances, the first inlet 132 may not include a check valve. For example, a check valve may be disposed upstream of the first inlet 132.

The beverage nozzle 100 may include a second inlet 142. The second inlet 142 may be in fluid communication with the housing 118 by way of the second fluid conduit 112. For example, the second inlet 142 may be in fluid communication with the elongated internal chamber 130 of the housing 118 by way of one or more openings in the housing 118. In some instances, the second inlet 142 may be disposed about the upper portion 120. The second inlet 142 may be disposed at any location about the housing 118. The second inlet 142 may be configured to provide the second beverage ingredient 110 (e.g., water) into the housing 118. In some instances, the second inlet 142 may be a check valve. In other instances, the flow valve 116 disposed about the second fluid conduit 112 may control the flow of the second beverage ingredient 110 to the second inlet 142. In certain embodiment, the second inlet 142 may include a nozzle 144 configured to inject the second beverage ingredient 110 into the housing 118. In some instances, as depicted in FIGS. 2-4 and 19-22, the second inlet 142 may include an adapter 143 attached to the second inlet 142.

Referring back to FIG. 6, in certain embodiments, a headspace 146 may be formed within the upper portion 120 between an internal surface 148 of the upper portion 120 and a mixing core 150 when the mixing core 150 is disposed within the housing 118, as described below. In some instances, the internal surface 148 within the upper portion 120 may be at least partially curved 152. In an example embodiment, the first inlet 132 and the second inlet 142 may be disposed about the headspace 146. In some instances, to facilitate mixing of the first beverage ingredient 106 and the second beverage ingredient 110, the first inlet 132 may be transverse to the second inlet 142. In certain embodiments, the second inlet 142 (e.g., the nozzle 144) may be angled towards the first inlet 132 or vice versa. The first inlet 132 and the second inlet 142 may be disposed in any location and in any orientation about the housing 118, including the upper portion 120 and/or the lower portion 122.

As noted above, the beverage nozzle 100 may include a mixing core 150 disposed within the housing 118. For example, as depicted in FIG. 4, the mixing core 150 may be an elongated structure configured to nest within at least a portion of the elongated internal chamber 130. The mixing core 150 may be configured to mix the first beverage ingredient 106 and the second beverage ingredient 110 into the homogeneous mixture.

In some instances, the mixing core 150 may be interchangeable and/or replaceable within the housing 118. For example, as noted above, the upper portion 120 and the lower portion 122 may be separated. The mixing core 150 may be added and/or removed from the housing 118 when the upper portion 120 and the lower portion 122 are separated. In some instances, the mixing core 150 may be disposable. That is, after the mixing core 150 is removed from the housing 118, it may be discarded. In other instances, the mixing core 150 may be permanently disposed within the housing 118. In certain embodiments, the mixing core 150 may be part of the housing 118. That is, the housing 118 may include an internal flow path that acts as the mixing core 150.

The mixing core 150 may be configured to create at least one of a turbulent flow, a laminar flow, or various combinations thereof within the housing 118 to ensure adequate mixing of the first beverage ingredient 106 and the second beverage ingredient 110. For example, in some instances, at least a portion of the mixing core 150 may define a turbulent flow path within the housing 18. Similarly, in some instances, at least a portion of the mixing core 150 may define a laminar flow path within the housing 118. In some instances, the mixing core 150 and the housing 118 may collectively define a laminar and/or turbulent flow path. The mixing core 150 may define any number of turbulent and/or laminar flow paths within the housing 118 in any sequence. For example, the mixing core 150 may define a turbulent-to-laminar flow path within the housing 118, or the mixing core 150 may define a turbulent-to-laminar-to-turbulent flow path within the housing 118. In some instances, the mixing core 150 may only define a turbulent flow path or a laminar flow path within the housing 118. The mixing core 150 may be any shape and/or size. Moreover, the mixing core 150 may define any type of flow path, including, but not limited to, S-shaped flow paths, labyrinths, partially obstructed flow paths, etc.

In certain embodiments, a mixing characteristic of the mixing core 150 may be dependent on the first beverage ingredient 106 and/or the second beverage ingredient 110. That is, depending on the composition of the first beverage ingredient 106 and/or the second beverage ingredient 110, one or more variables associated with the mixing core 150 may be varied. For example, the flow path shape, sequence, mixing rate, and/or length of the mixing core 150 may vary to ensure sufficient mixing of the first beverage ingredient 106 and the second beverage ingredient 110. In some instances, the mixing core 150 may be interchangeable with other mixing cores 150 having suitable mixing rates, flow path shapes, sequences, and/or lengths that correlate to the first beverage ingredient 106 and/or the second beverage ingredient 110 to ensure sufficient mixing thereof. That is, depending on what type of ingredient the first beverage ingredient 106 and/or the second beverage ingredient 110 is, the mixing core 150 may be replaced (or swapped out) with another mixing core 150 that is more suitable for mixing the ingredient.

FIGS. 15-18 depict an example mixing core 150. The mixing core 150 may include a number of openings 154 and obstructions 156 which create a labyrinth 158 for the first beverage ingredient 106 and the second beverage ingredient 110 to pass through. The labyrinth 158 may impart a turbulent flow into the first beverage ingredient 106 and the second beverage ingredient 110 to ensure adequate mixing thereof. The mixing core 150 may include other configurations. For example, the mixing core 150 may include one or more turbulent flow sections and/or one or more, laminar flow sections. Moreover, the mixing core 150 may include various combinations of flow path shapes, sequences, mixing rates, and/or lengths. The configuration of the mixing core 150 may be related to the beverage ingredients to be mixed.

Figure 11:
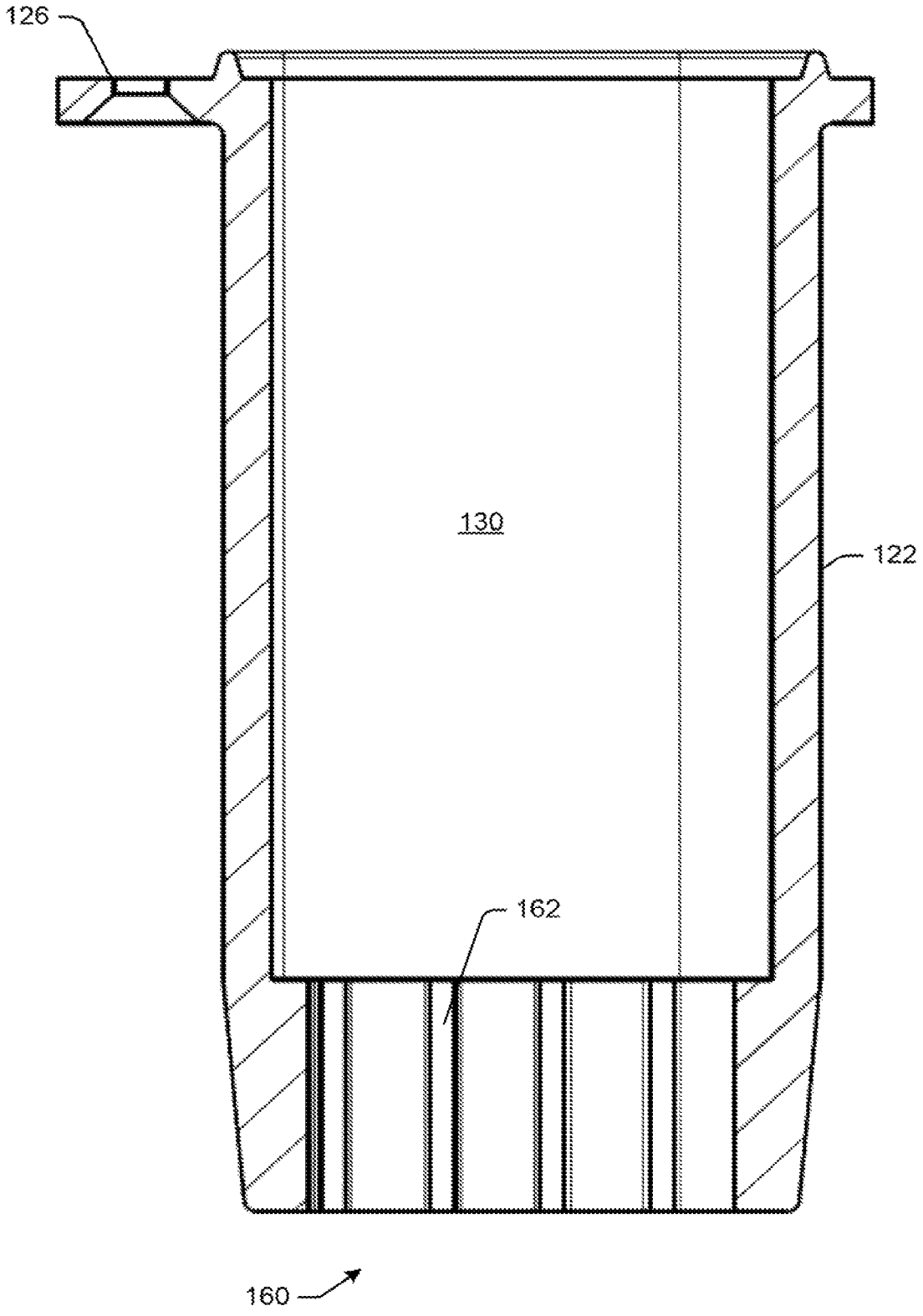
FIG. 11 depicts cross-sectional view of a lower portion of a beverage nozzle in accordance with one or more embodiments of the disclosure.
Figure 12:
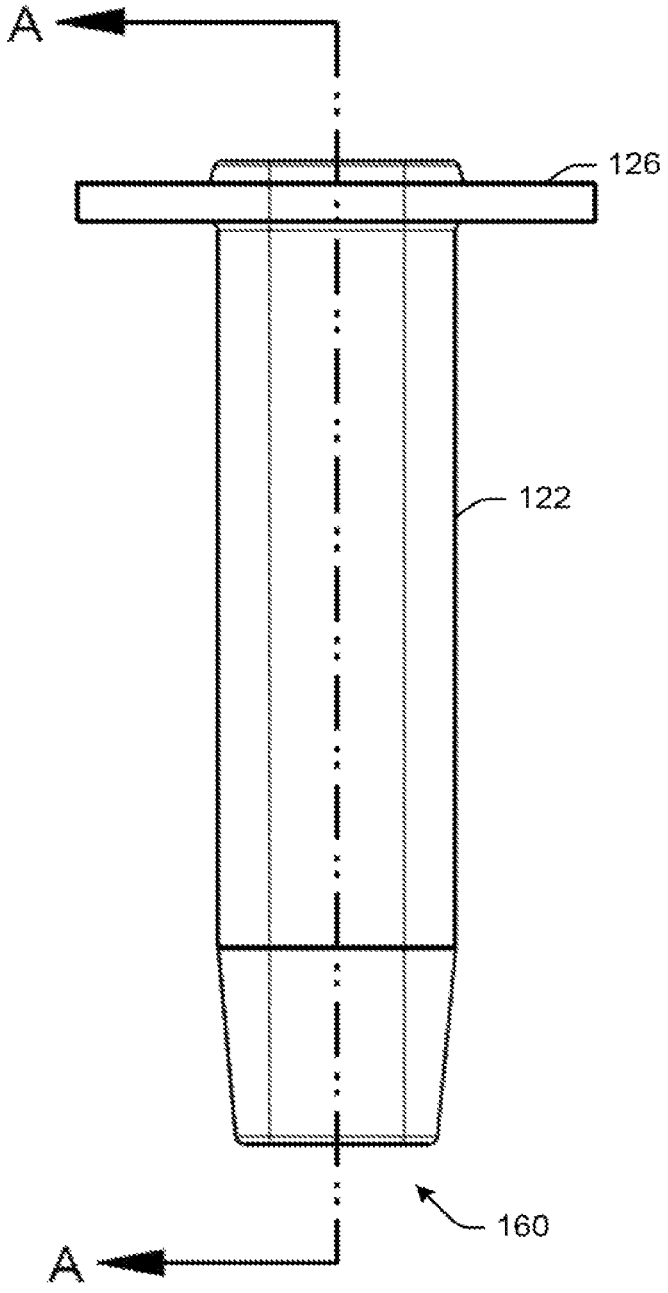
FIG. 12 depicts a lower portion of a beverage nozzle in accordance with one or more embodiments of the disclosure.
Figure 13:
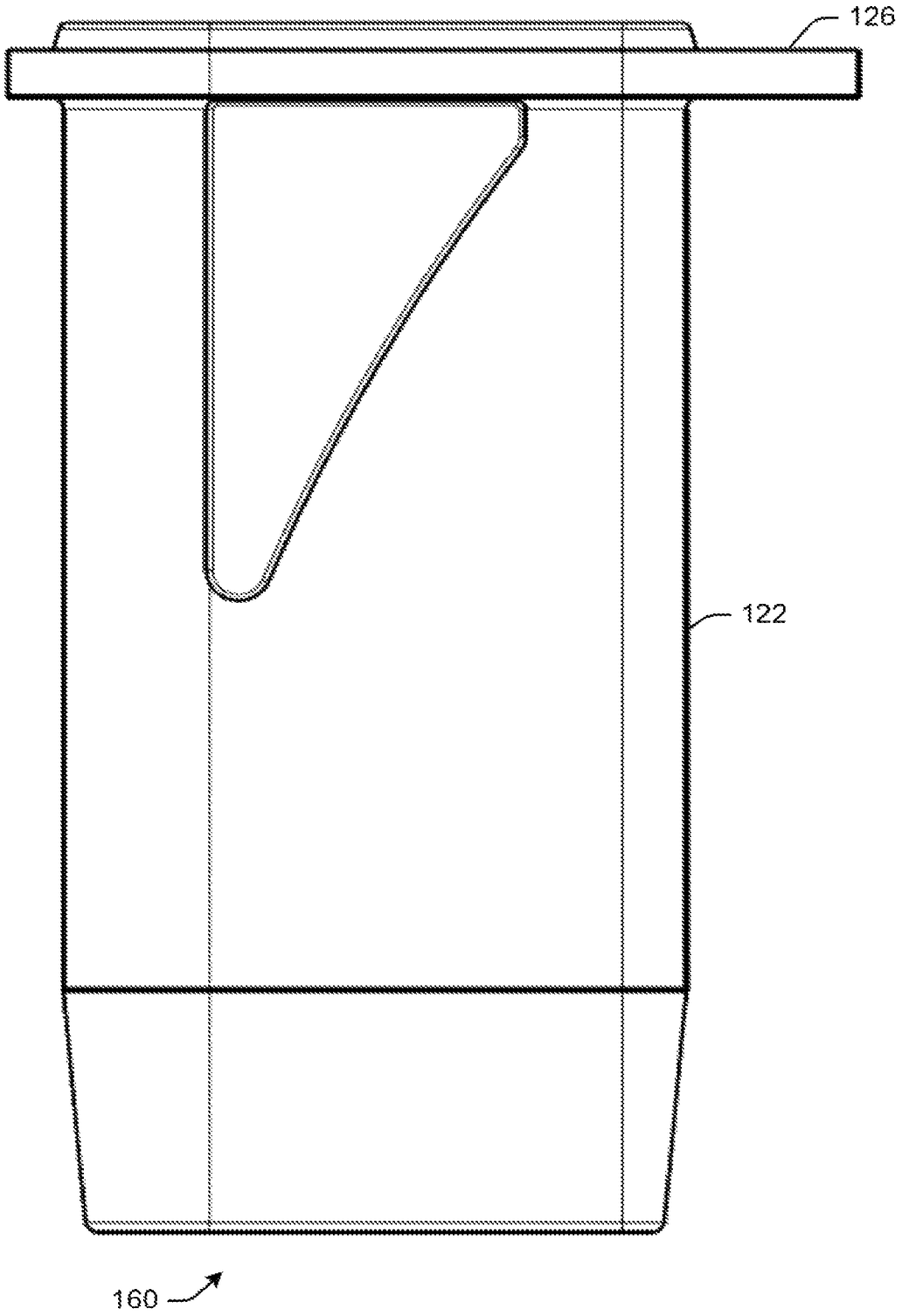
FIG. 13 depicts a lower portion of a beverage nozzle in accordance with one or more embodiments of the disclosure.
Figure 14:
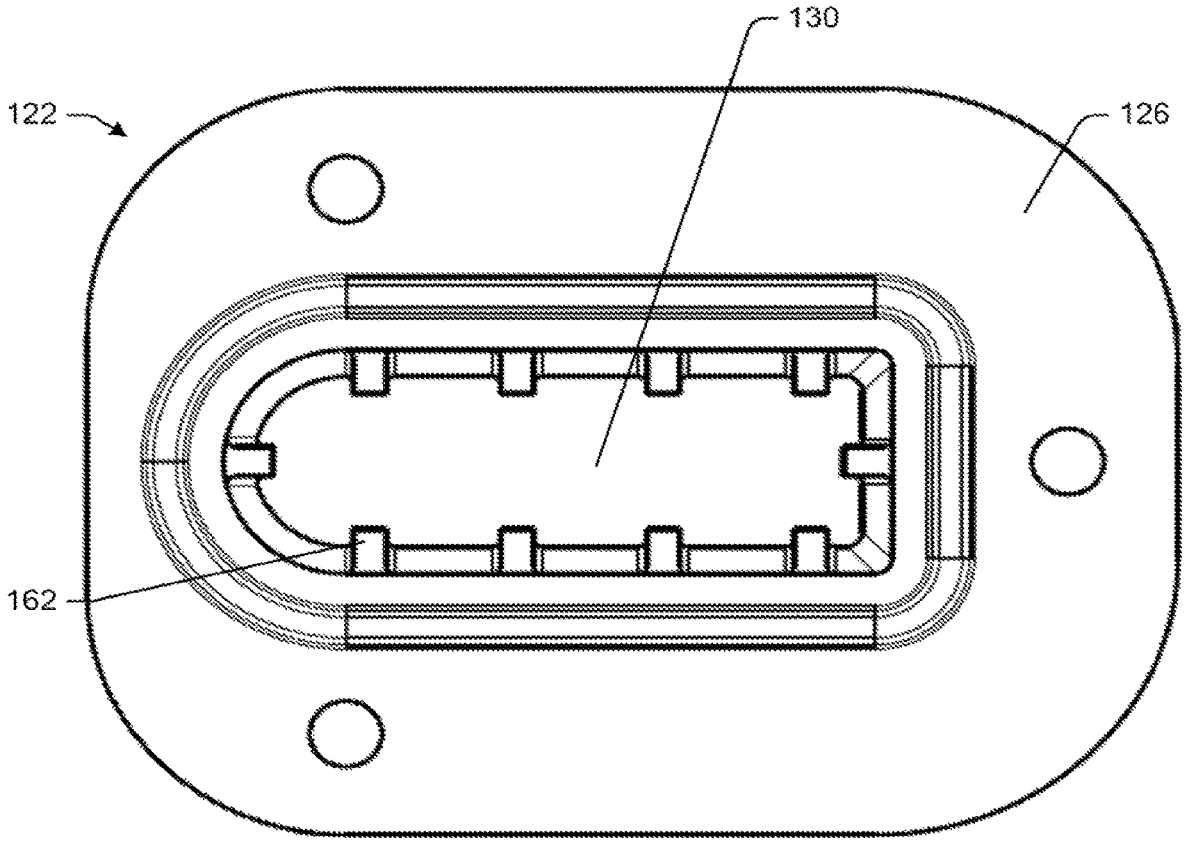
FIG. 14 depicts a lower portion of a beverage nozzle in accordance with one or more embodiments of the disclosure.
Figure 15:
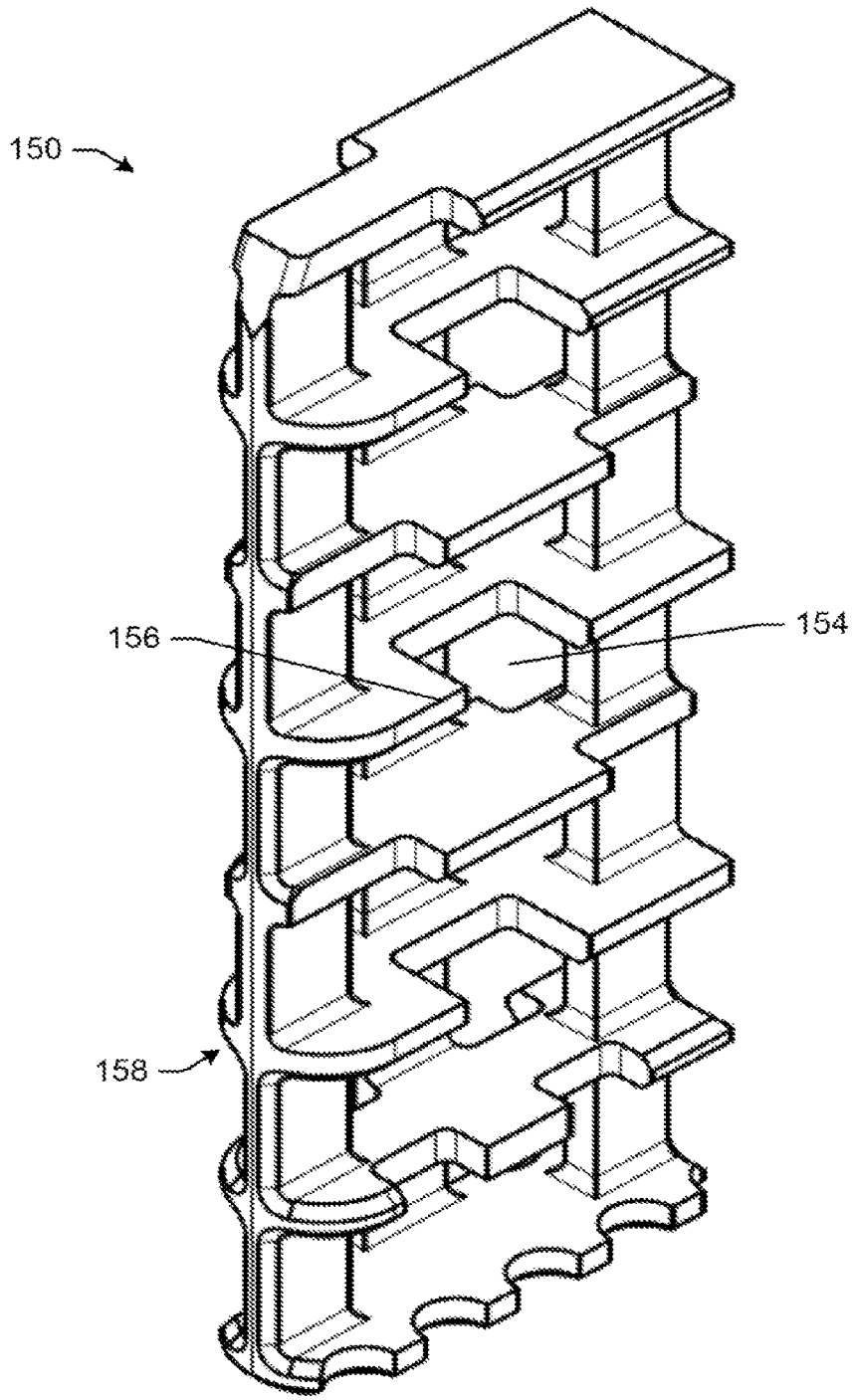
FIG. 15 depicts a mixing core of a beverage nozzle in accordance with one or more embodiments of the disclosure.
Figure 16:
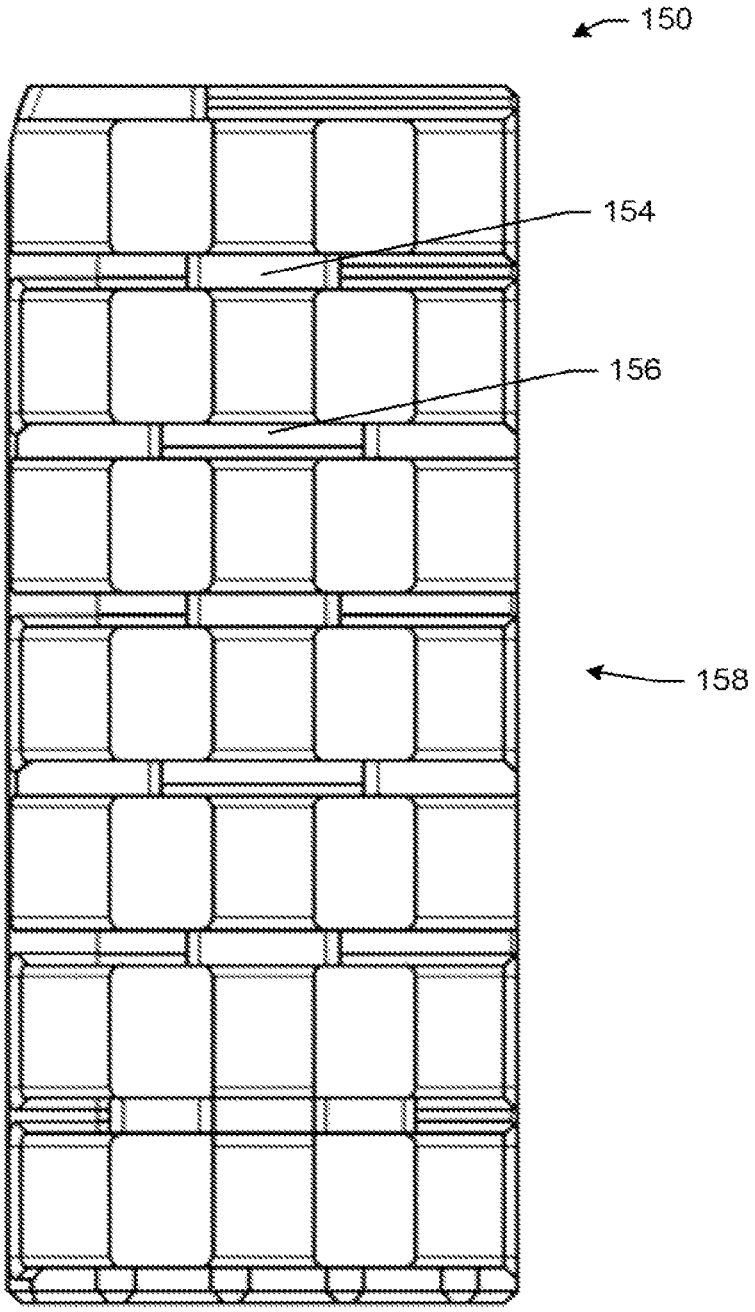
FIG. 16 depicts a mixing core of a beverage nozzle in accordance with one or more embodiments of the disclosure.
Figure 17:
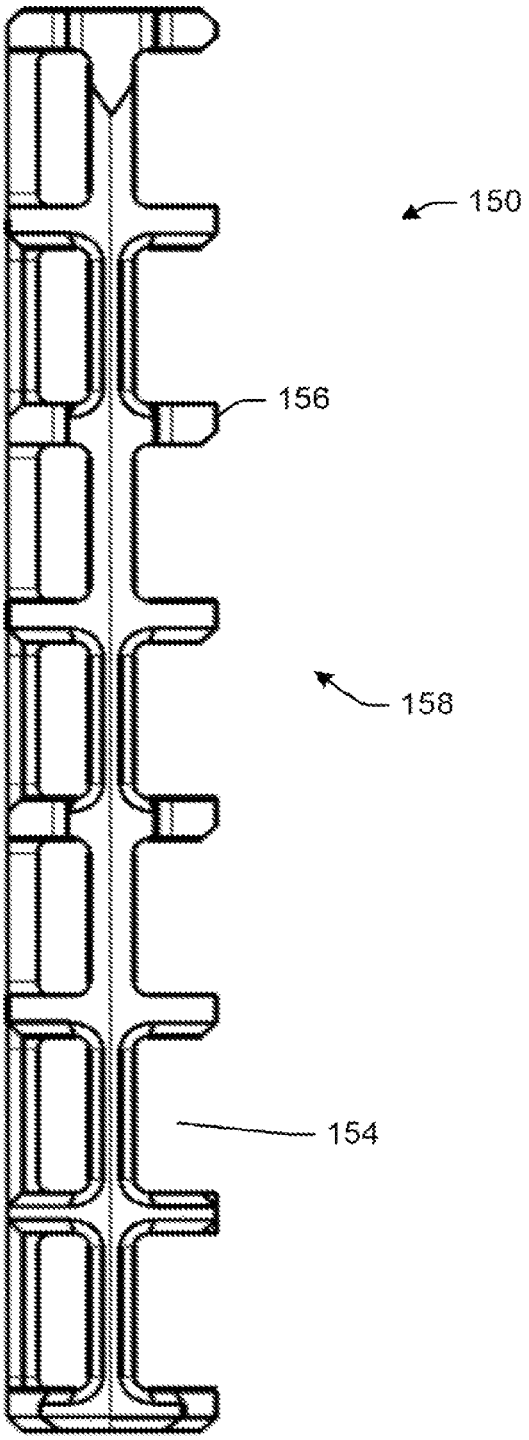
FIG. 17 depicts a mixing core of a beverage nozzle in accordance with one or more embodiments of the disclosure.
Figure 18:
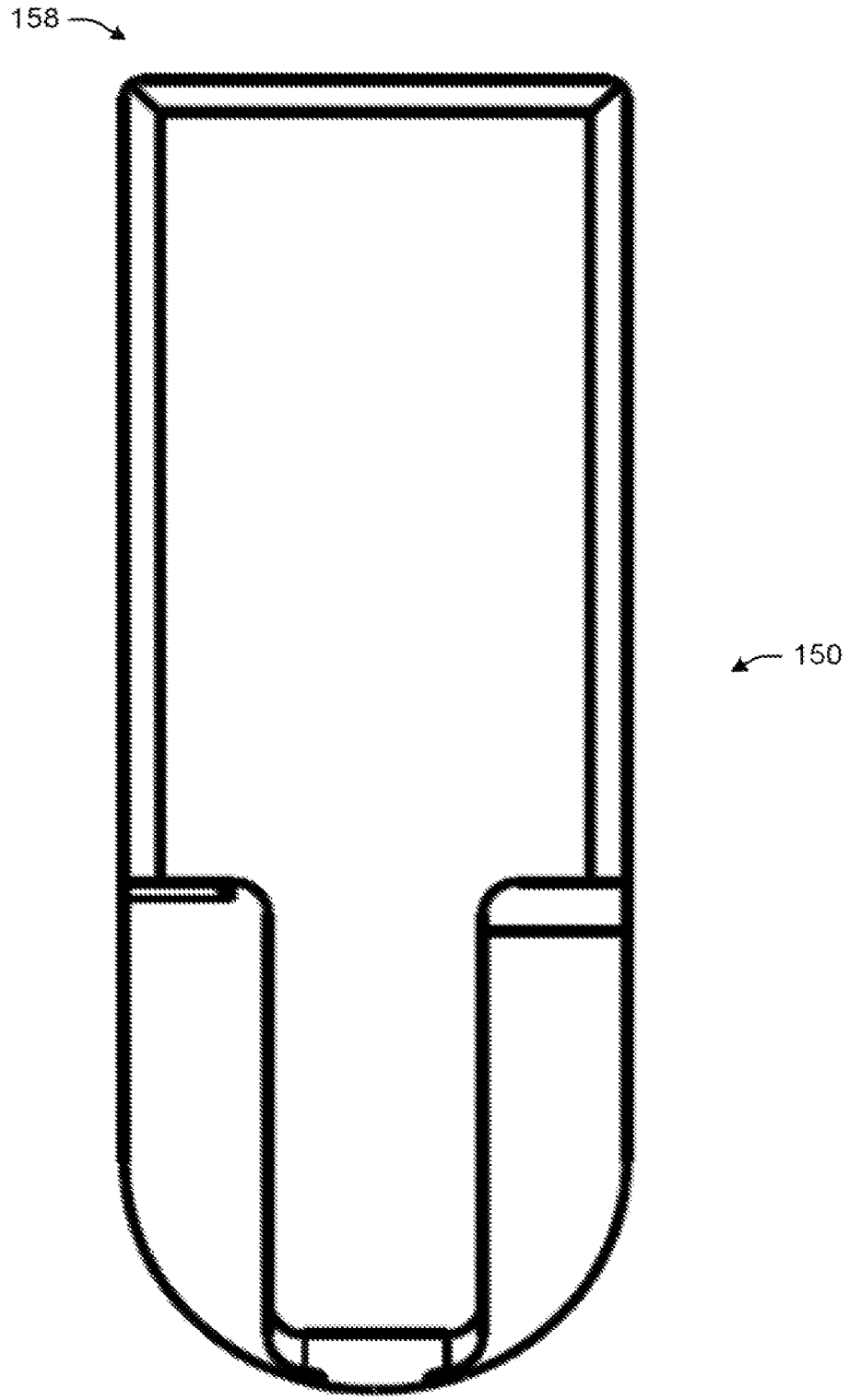
FIG. 18 depicts a mixing core of a beverage nozzle in accordance with one or more embodiments of the disclosure.
Figure 19:
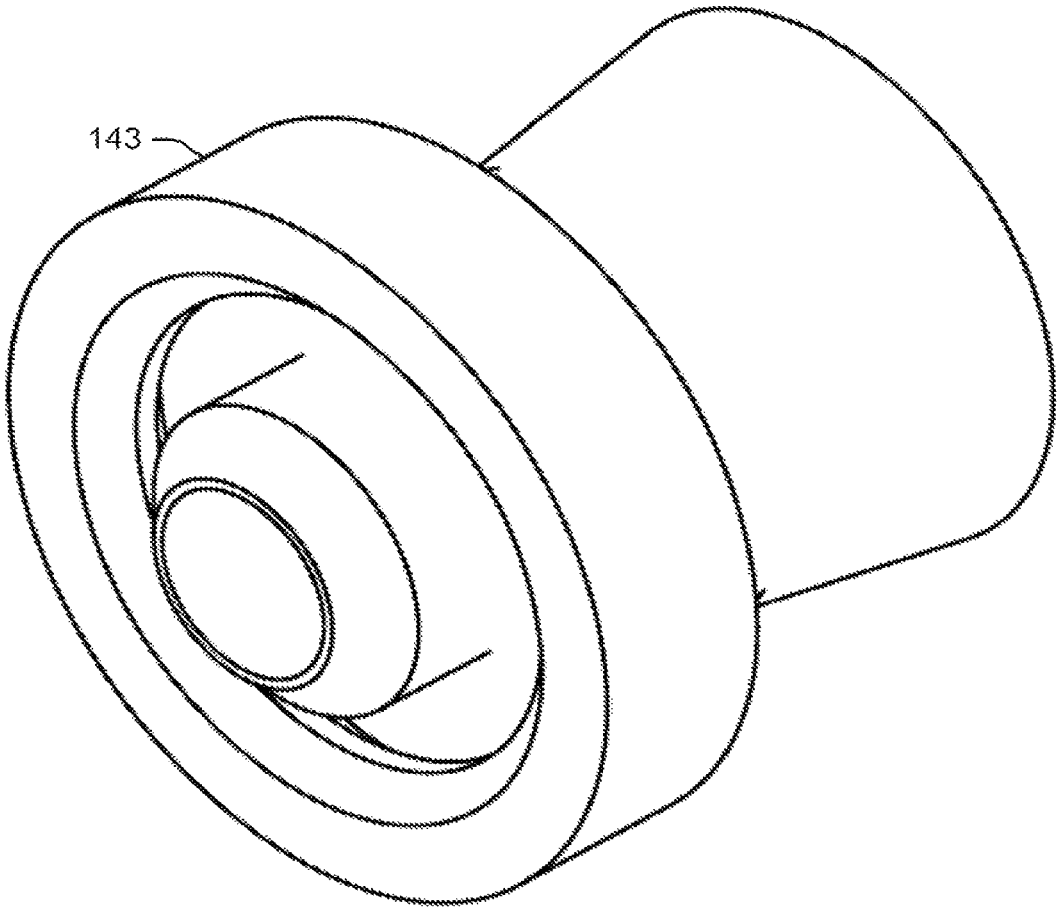
FIG. 19 depicts an adapter of a beverage nozzle in accordance with one or more embodiments of the disclosure.
Figure 20:
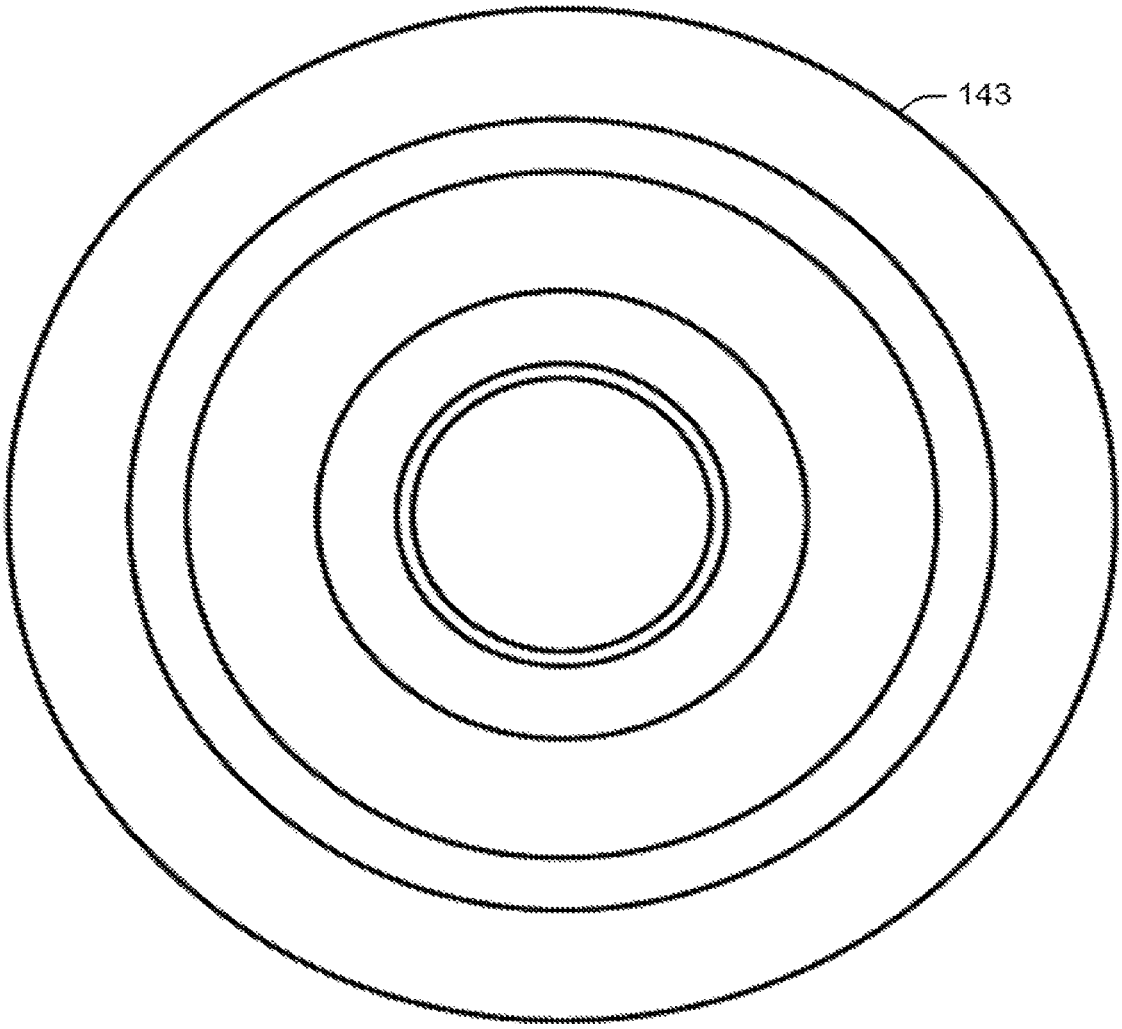
FIG. 20 depicts an adapter of a beverage nozzle in accordance with one or more embodiments of the disclosure.
Figure 21:
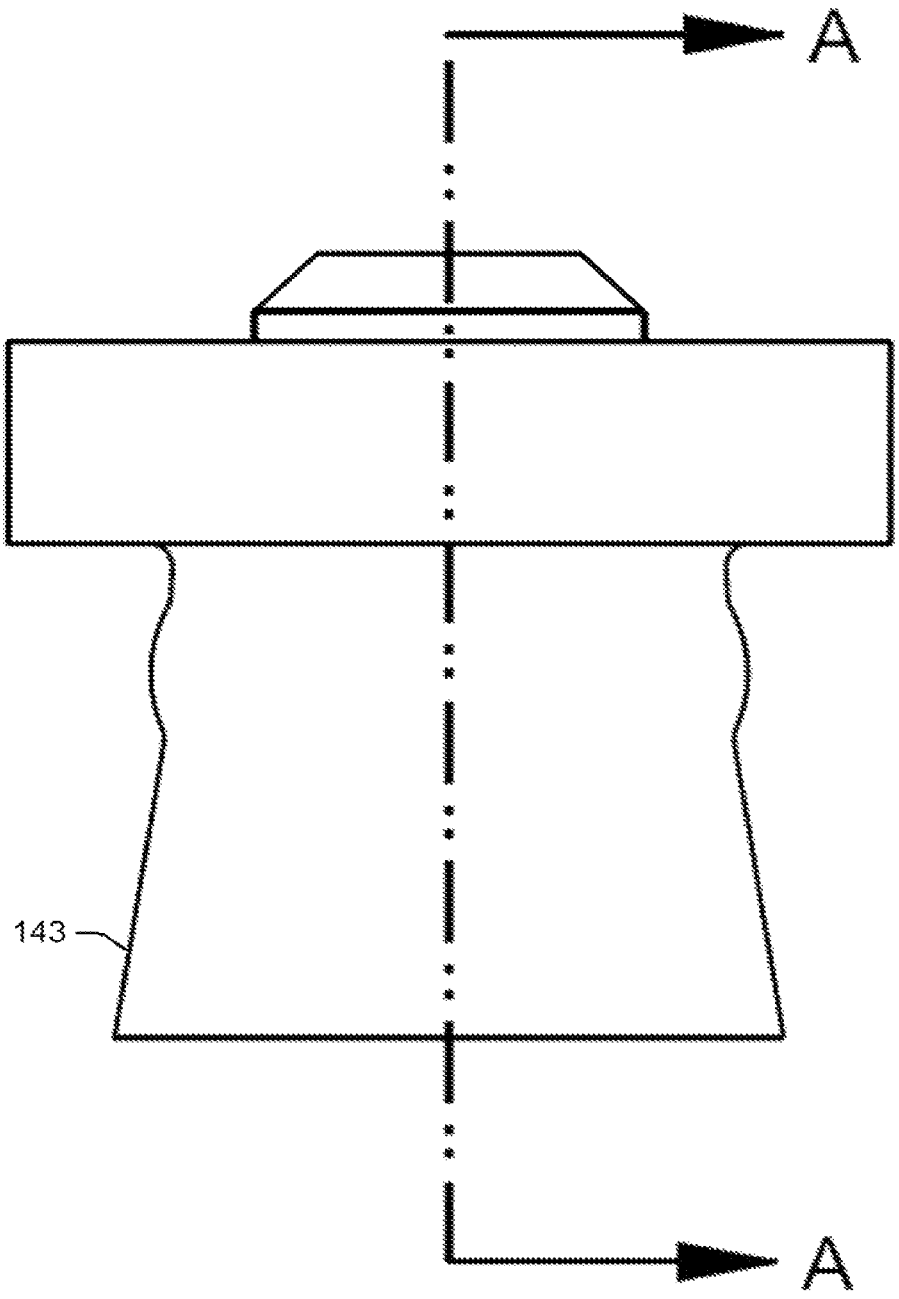
FIG. 21 depicts an adapter of a beverage nozzle in accordance with one or more embodiments of the disclosure.
Figure 22:
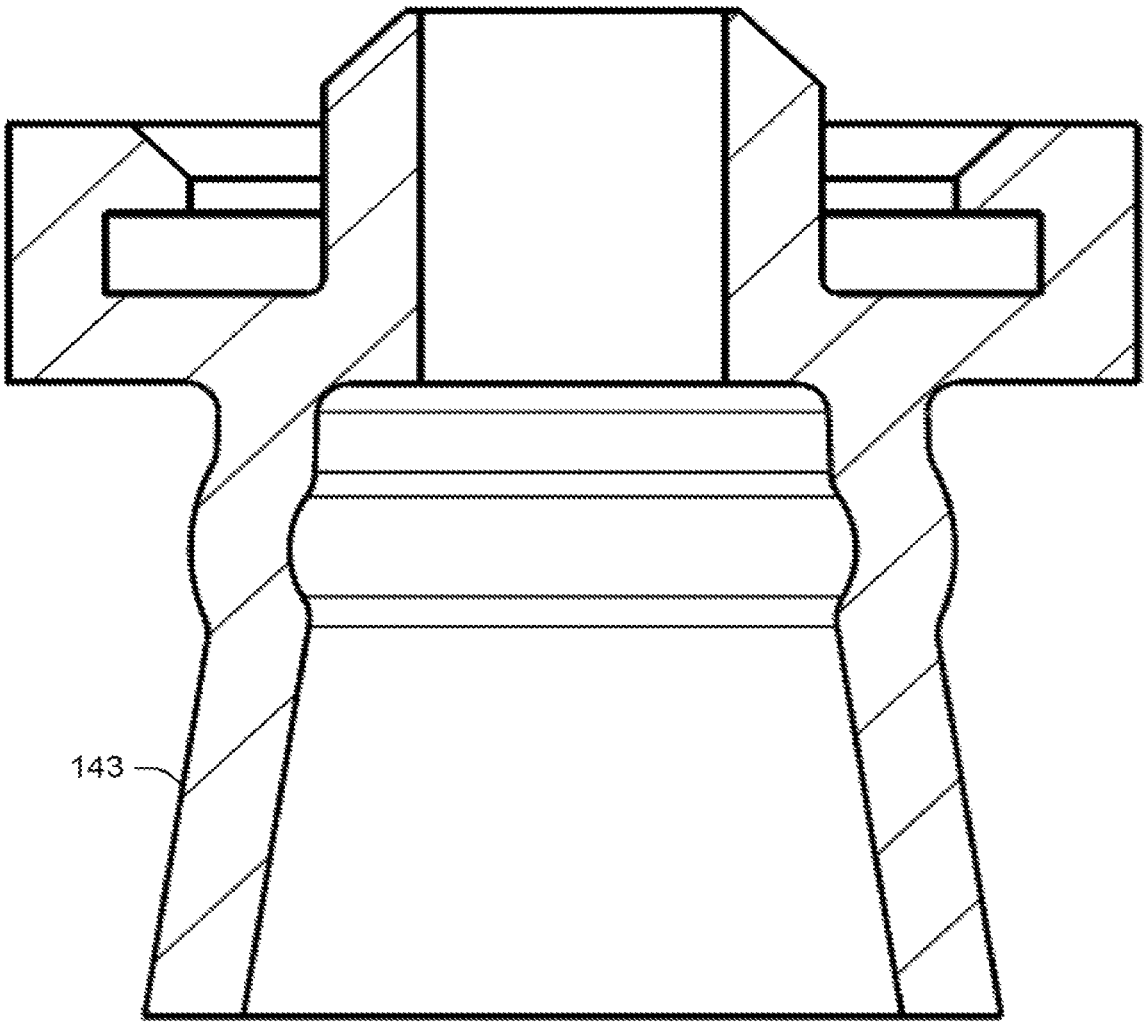
FIG. 22 depicts a cross-sectional view of an adapter of a beverage nozzle in accordance with one or more embodiments of the disclosure.

As depicted in FIG. 11, the homogeneous mixture may exit the housing 118 by way of an outlet 160 disposed about the lower portion 122. In some instances, one or more ribs 162 and/or openings 163 may be disposed about the outlet 160 to impart a laminar flow to the homogeneous mixture. In some instances, the ribs 162 and/or openings 163 may be configured to complement the mixing core 150. That is, the ribs 162 and/or openings 163 may align with the mixing core 150 so as to impart a laminar flow to the turbulent homogeneous mixture exiting the mixing core 150. In other instances, the ribs 162 and/or openings 163 may be omitted. For example, the shape of the outlet 160 may impart a laminar flow to the homogeneous mixture. The outlet 160 may be any shape and/or configuration. Moreover, the outlet 160 may be configured to impart a turbulent flow to the homogeneous mixture.

As noted above, the first beverage ingredient 106 and the second beverage ingredient 110 may be mixed within the housing 118. In some instances, to ensure adequate mixing of the first beverage ingredient 106 and the second beverage ingredient 110, at least a portion of the mixing core 150 and/or the housing 118 may be textured. The textured surfaces of the mixing core 150 and/or housing 118 may increase the mixing of the first beverage ingredient 106 and the second beverage ingredient 110. In some instances, at least a portion of the mixing core 150 and/or the housing 118 may be smooth. Any combination of textured and/or smooth surfaces may be used.

Figure 23:
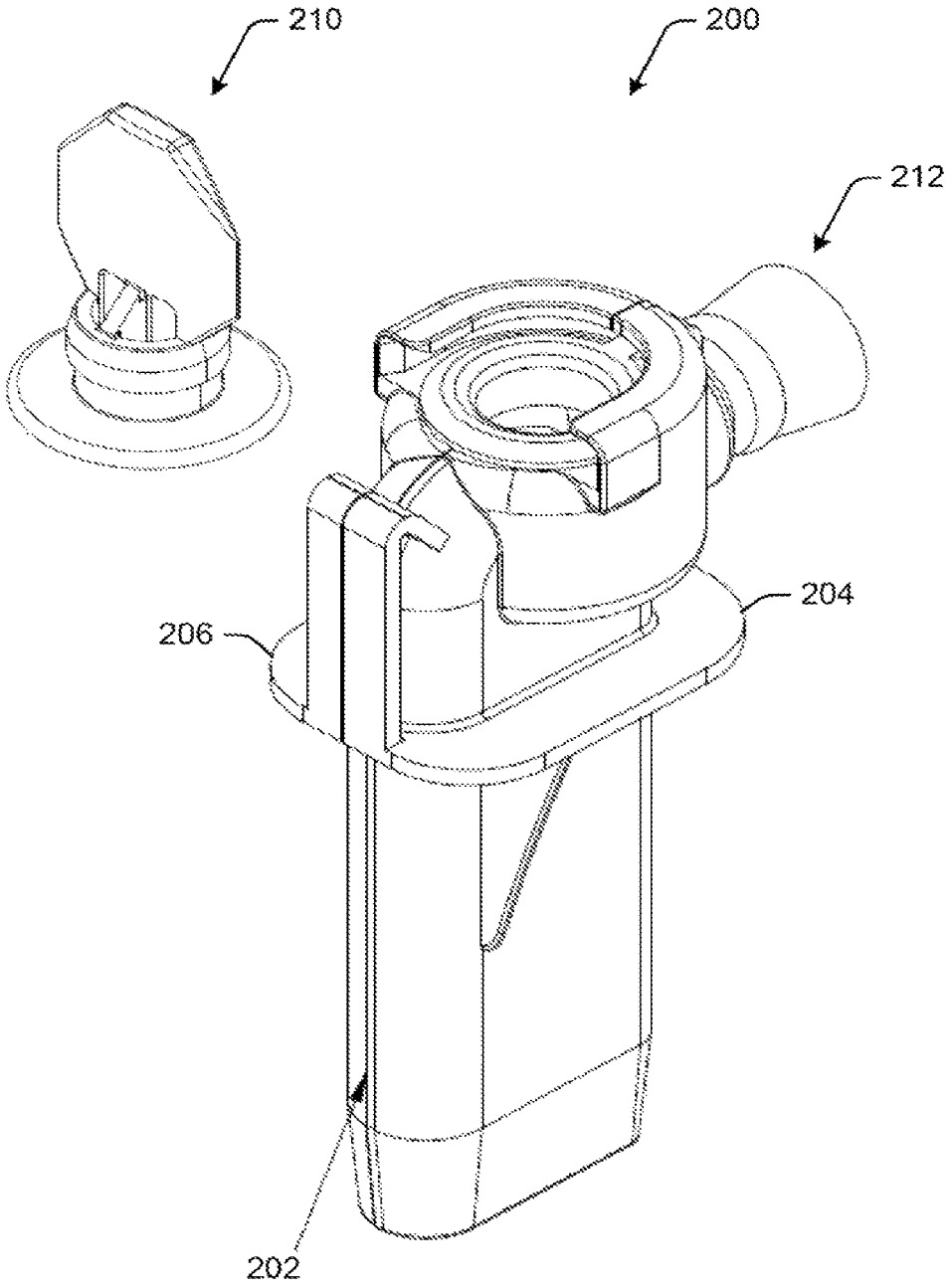
FIG. 23 depicts a partially exploded view of a beverage nozzle in accordance with one or more embodiments of the disclosure.
Figure 24:
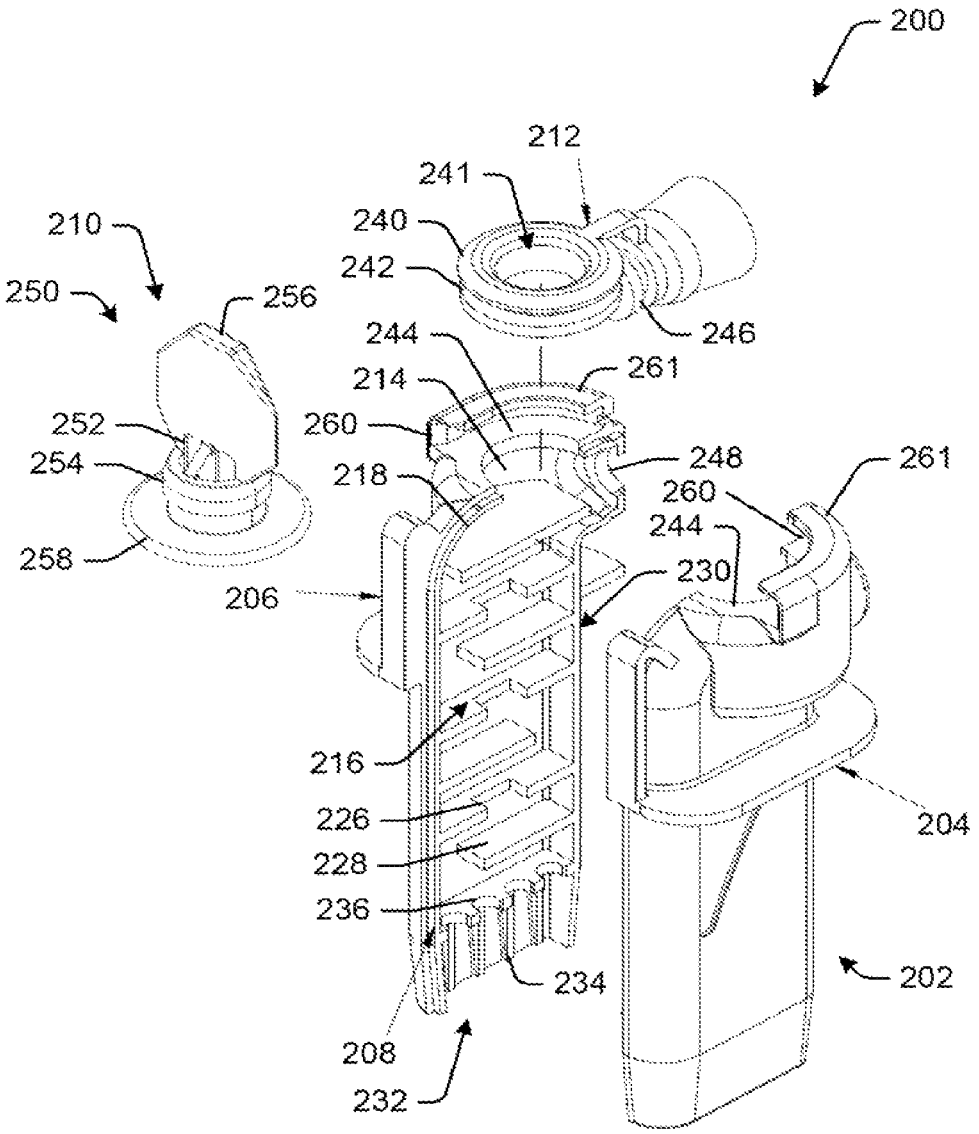
FIG. 24 depicts an exploded view of a beverage nozzle in accordance with one or more embodiments of the disclosure.

FIGS. 23-30 depict a beverage nozzle 200 as may be used herein. The beverage nozzle 200 may be used in conjunction with or instead of the beverage nozzle 100. As depicted in FIGS. 23 and 24, the beverage nozzle 200 may include a housing 202 having a first side 204 and a second side 206. In some instances, the first side 204 and the second side 206 of the housing 202 may form a single unitary structure. In other instances, the first side 204 and the second side 206 of the housing 202 may be attached and detached from each other. In one example, the first side 204 and the second side 206 of the housing 202 may be welded together. For example, the first side 204 and the second side 206 of the housing 202 may be ultrasonically welded together. Any suitable attachment mechanism that enables the first side 204 and the second side 206 of the housing 202 to be separated and/or attached may be used.

Figure 25:
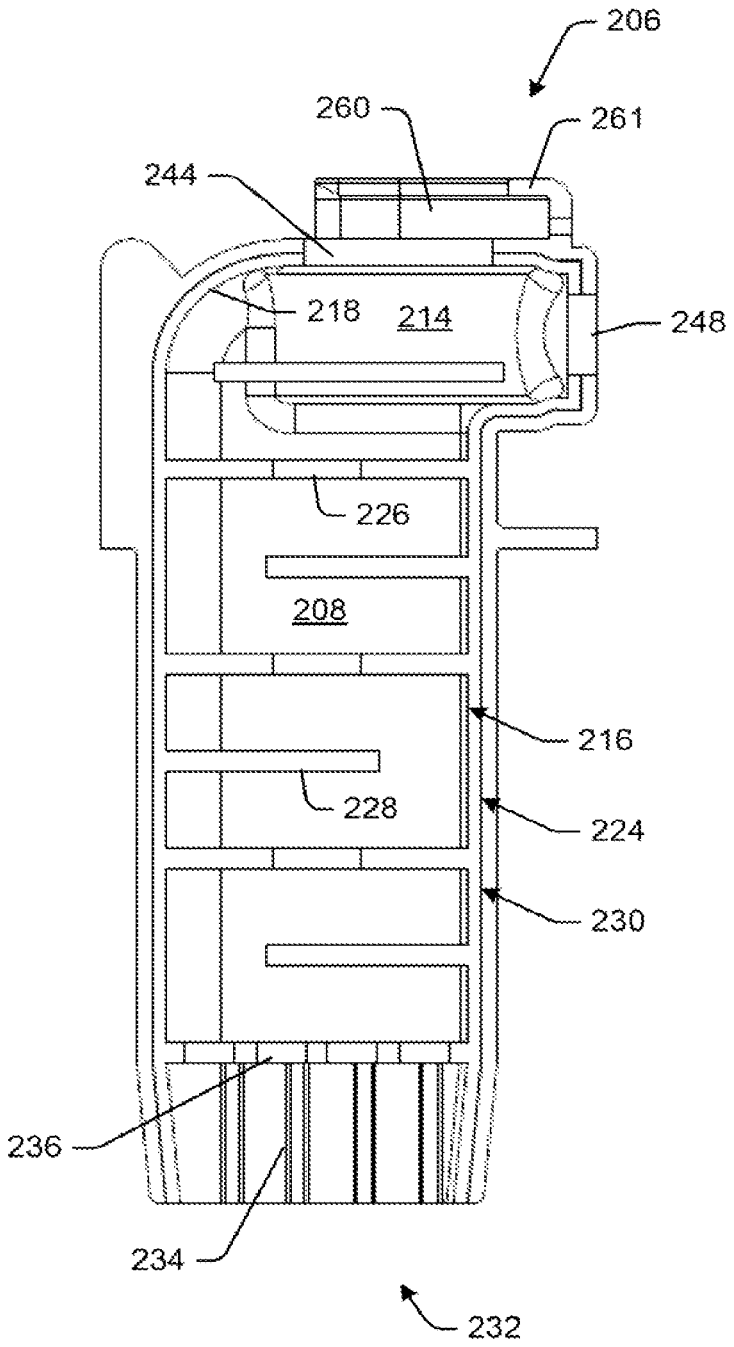
FIG. 25 depicts a side portion of a beverage nozzle in accordance with one or more embodiments of the disclosure.
Figure 26:
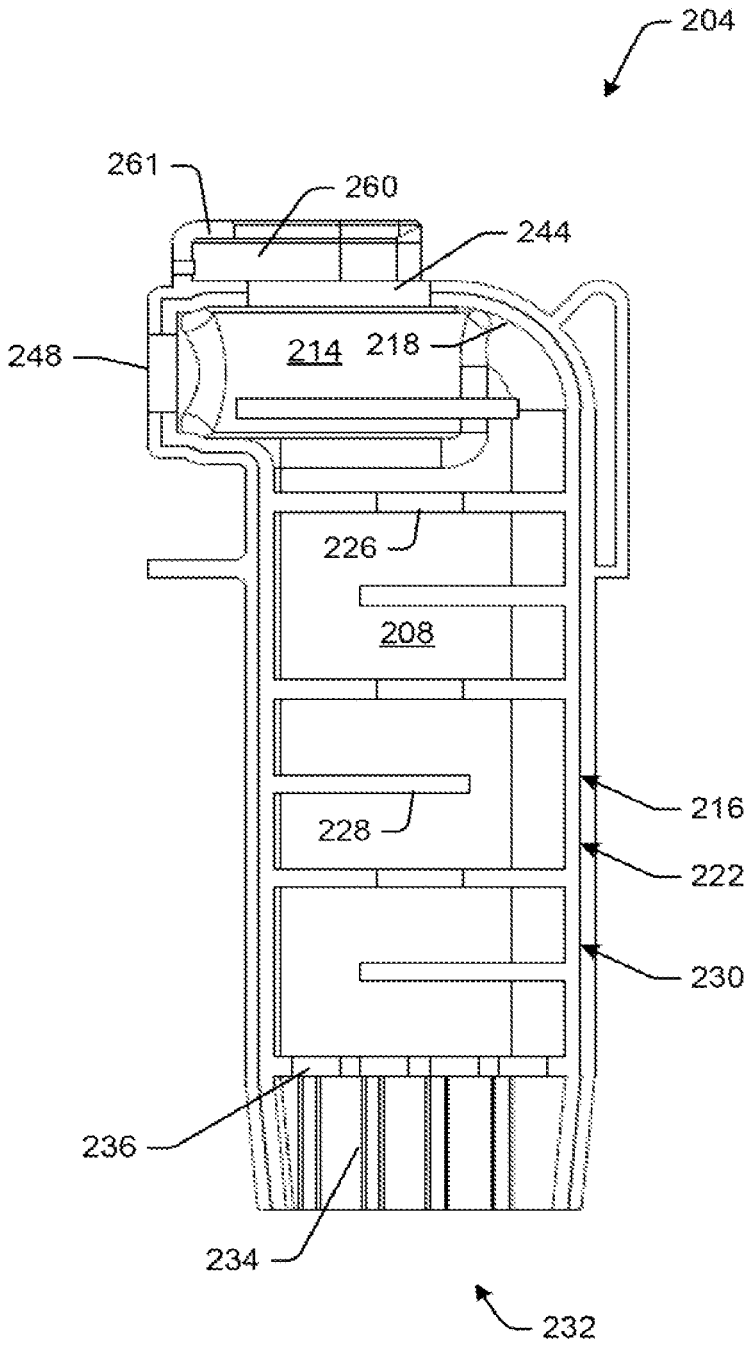
FIG. 26 depicts a side portion of a beverage nozzle in accordance with one or more embodiments of the disclosure.

In some instances, as depicted in FIGS. 24-26, the housing 202 may define an elongated internal chamber 208. The elongated internal chamber 208 may be in fluid communication with a first inlet 210 and a second inlet 212 via one or more openings in the housing 202. The elongated internal chamber 208 may include a headspace 214. The elongated internal chamber 208 also may include a mixing core 216 disposed therein. In some instances, an internal surface 218 within the elongated internal chamber 208 may be at least partially curved. In an example embodiment, the first inlet 210 and the second inlet 212 may be disposed about the headspace 214. In some instances, to facilitate mixing of the first beverage ingredient 106 and the second beverage ingredient 110, the first inlet 210 may be transverse to the second inlet 212. In certain embodiments, the second inlet 212 (e.g., a nozzle 238) may be angled towards the first inlet 210 or vice versa. The first inlet 210 and the second inlet 212 may be disposed in any location and in any orientation about the housing 202.

In certain embodiments, the mixing core 216 may be an elongated structure configured to nest within at least a portion of the elongated internal chamber 208. The mixing core 216 may be configured to mix the first beverage ingredient 106 and the second beverage ingredient 110 into the homogeneous mixture.

In some instances, the mixing core 216 may be interchangeable and/or replaceable within the housing 202. For example, the mixing core 150 described above with reference to FIGS. 1-22 may be disposed within the internal chamber 208. In other instances, as depicted in FIGS. 25 and 26, the mixing core 216 may include a first half 222 disposed within the first side 204 of the housing 202 and a second half 224 disposed within the second side 206 of the housing 202. That is, the first half 222 and the second half 224 may collective form the mixing core 216 when the first side 204 and the second side 206 of the housing 202 are joined together.

The mixing core 216 may be configured to create at least one of a turbulent flow, a laminar flow, or various combinations thereof within the housing 202 to ensure adequate mixing of the first beverage ingredient 106 and the second beverage ingredient 110. For example, in some instances, at least a portion of the mixing core 216 may define a turbulent flow path within the housing 202. Similarly, in some instances, at least a portion of the mixing core 216 may define a laminar flow path within the housing 202. In some instances, the mixing core 216 and the housing 202 may collectively define a laminar and/or turbulent flow path. The mixing core 216 may define any number of turbulent and/or laminar flow paths within the housing 202 in any sequence. For example, the mixing core 216 may define a turbulent-to-laminar flow path within the housing 202, or the mixing core 216 may define a turbulent-to-laminar-to-turbulent flow path within the housing 202. In some instances, the mixing core 216 may only define a turbulent flow path or a laminar flow path within the housing 202. The mixing core 216 may be any shape and/or size. Moreover, the mixing core 216 may define any type of flow path, including, but not limited to, S-shaped flow paths, labyrinths, partially obstructed flow paths, etc.

In certain embodiments, a mixing characteristic of the mixing core 216 may be dependent on the first beverage ingredient 106 and/or the second beverage ingredient 110. That is, depending on the composition of the first beverage ingredient 106 and/or the second beverage ingredient 110, one or more variables associated with the mixing core 216 may be varied. For example, the flow path shape, sequence, mixing rate, and/or length of the mixing core 216 may vary to ensure sufficient mixing of the first beverage ingredient 106 and the second beverage ingredient 110. In some instances, the mixing core 216 may be interchangeable with other mixing cores having suitable mixing rates, flow path shapes, sequences, and/or lengths that correlate to the first beverage ingredient 106 and/or the second beverage ingredient 110 to ensure sufficient mixing thereof. That is, depending on what type of ingredient the first beverage ingredient 106 and/or the second beverage ingredient 110 is, the mixing core 216 may be replaced (or swapped out) with another mixing core that is more suitable for mixing the ingredient. In other instances, the mixing core 216 may be integrally formed within the housing 202. For example, the first half 222 of the mixing core 216 may be integral with the first side 204 of the housing 202, and the second half 224 of the mixing core 216 may be integral with the second side 206 of the housing 202.

The mixing core 216 may include a number of openings 226 and obstructions 228 that create a labyrinth 230 for the first beverage ingredient 106 and the second beverage ingredient 110 to pass through. The labyrinth 230 may impart a turbulent flow into the first beverage ingredient 106 and the second beverage ingredient 110 to ensure adequate mixing thereof. The mixing core 216 may include other configurations. For example, the mixing core 216 may include one or more turbulent flow sections and/or one or more laminar flow sections. Moreover, the mixing core 216 may include various combinations of flow path shapes, sequences, mixing rates, and/or lengths. The configuration of the mixing core 216 may be related to the beverage ingredients to be mixed.

The homogeneous mixture may exit the housing 202 by way of an outlet 232. In some instances, one or more ribs 234 and/or openings 236 may be disposed about the outlet 232 to impart a laminar flow to the homogeneous mixture. In some instances, the ribs 234 and/or openings 236 may be configured to complement the mixing core 216. That is, the ribs 234 and/or openings 236 may align with the mixing core 216 so as to impart a laminar flow to the turbulent homogeneous mixture exiting the mixing core 216. In other instances, the ribs 234 and/or openings 236 may be omitted. For example, the shape of the outlet 232 may impart a laminar flow to the homogeneous mixture. In other instances, the outlet 232 may impart a turbulent flow to the homogeneous mixture. The outlet 232 may be any shape and/or configuration.

As noted above, the first beverage ingredient 106 and the second beverage ingredient 110 may be mixed within the housing 202. In some instances, to ensure adequate mixing of the first beverage ingredient 106 and the second beverage ingredient 110, at least a portion of the mixing core 216 and/or the housing 202 may be textured. The textured surfaces of the mixing core 216 and/or housing 202 may increase the mixing of the first beverage ingredient 106 and the second beverage ingredient 110. In some instances, at least a portion of the mixing core 216 and/or the housing 202 may be smooth. Any combination of textured and/or smooth surfaces may be used.

Figure 28:
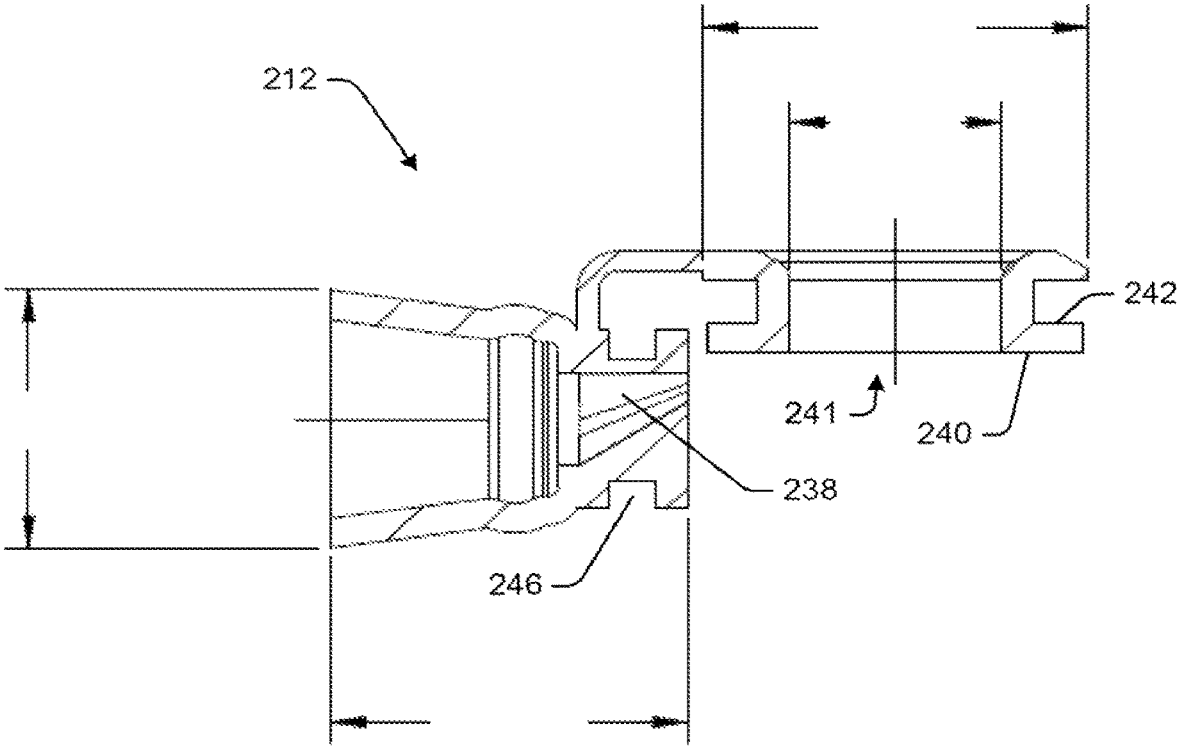
FIG. 28 depicts a cross-sectional view of an inlet of a beverage nozzle in accordance with one or more embodiments of the disclosure.

The second inlet 212 may be in fluid communication with the housing 202 by way of the second fluid conduit 112. The second inlet 212 may be disposed at any location about the housing 202. The second inlet 212 may be configured to provide the second beverage ingredient 110 (e.g., water) into the housing 202. In some instances, the second inlet 212 may be a check valve. In other instances, the flow valve 116 disposed about the second fluid conduit 112 may control the flow of the second beverage ingredient 110 to the second inlet 212. In certain embodiment, as depicted in FIG. 28, the second inlet 212 may include a nozzle 238 configured to inject the second beverage ingredient 110 into the housing 202. For example, the nozzle 238 may inject the second beverage ingredient 110 into the headspace 214.

Figure 27:
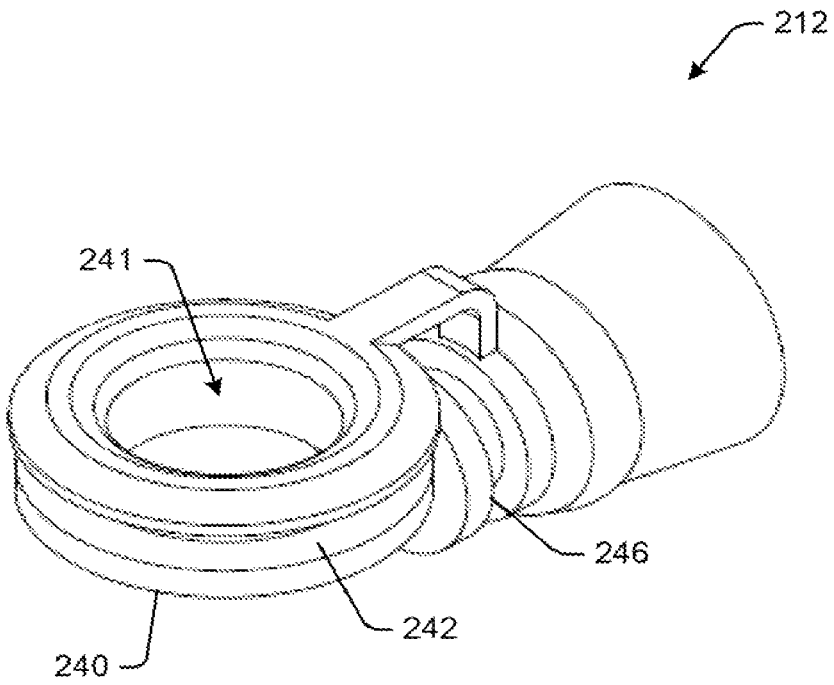
FIG. 27 depicts an inlet of a beverage nozzle in accordance with one or more embodiments of the disclosure.

In certain embodiments, as depicted in FIGS. 24, 27, and 28, the second inlet 212 may include a top ring 240 attached thereto. The top ring 240 may be generally transverse to the second inlet 212. The top ring 240 may include an aperture 241 therethrough. The second inlet 212 and the top ring 240 may be configured to be at least partially sandwiched between the first side 204 and the second side 206 of the housing 202 when the beverage nozzle 200 is assembled together. For example, the top ring 240 may include a circular groove 242 disposed about the aperture 241. The circular groove 242 may be configured to mate with and form a seal about a circular rim 244 of the housing 202. Likewise, the second inlet 212 may include a circular groove 246 disposed about the nozzle 238. The circular groove 246 may be configured to mate with and form a seal about a circular rim 248 of the housing 202. In this manner, the second inlet 212 and the top ring 240 may be positioned between the first side 204 and the second side 206 of the housing 202 and secured in place when the first side 204 and the second side 206 of the housing 202 are attached together. In this manner, the second inlet 212 may be easily removed, replaced, and/or swapped out with other types of inlets.

The first inlet 210 may be in fluid communication with the housing 202. The first inlet 210 may be disposed at any location about the housing 202. For example, the first inlet 210 may be in fluid communication with the headspace 214 of the internal chamber 208. The first inlet 210 may be configured to provide the first beverage ingredient 106 to the housing 202. For example, the first inlet 210 may be in fluid communication with the container 102 by way of the first fluid conduit 104.

Figure 29:
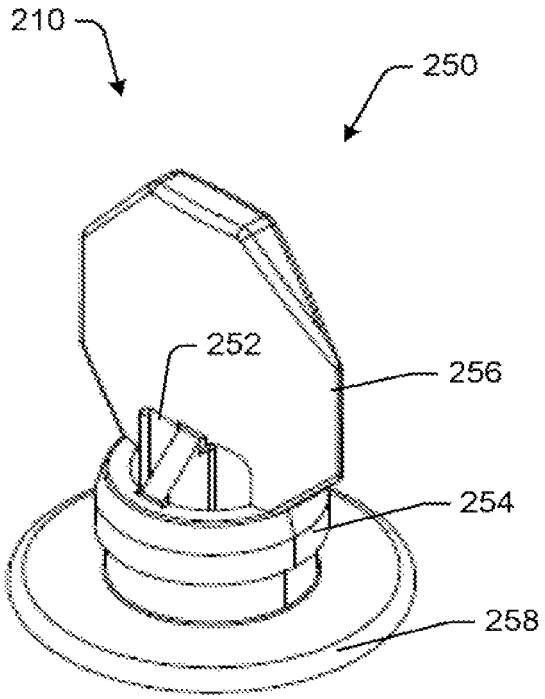
FIG. 29 depicts an inlet of a beverage nozzle in accordance with e or more embodiments of the disclosure.
Figure 30:
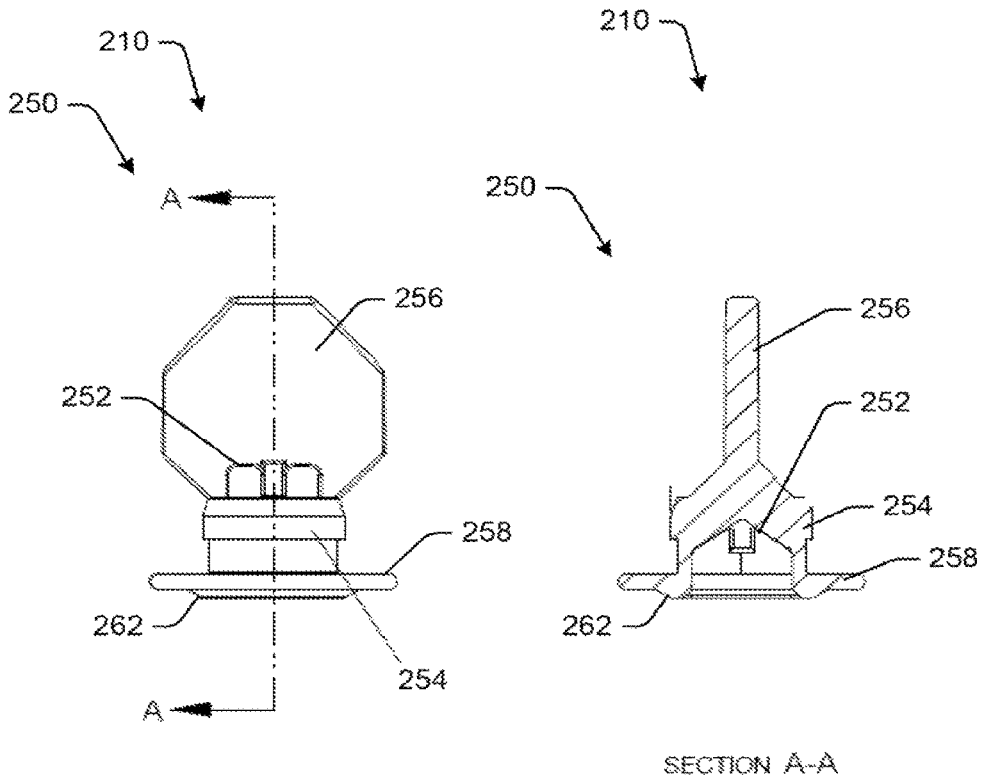
FIG. 30 depicts a side and cross-sectional view of an inlet of a beverage nozzle in accordance with one or more embodiments of the disclosure.

In some instances, in order to prevent backflow into the container 102, the first inlet 210 may be a check valve 250. For example, as depicted in FIGS. 24, 29, and 30, the first inlet 210 may include an opening 252 disposed between a barbed portion 254 and a head portion 256. In some instances, the head portion 256 may be a duckbill or the like. The head portion 256 may be inserted into the first fluid conduit 104 such that the first fluid conduit 104 passes over the barbed portion 254. An outer diameter of the barbed portion 254 may be greater than an inner diameter of the first fluid conduit 104. In this manner, the first fluid conduit 104 may be a flexible material that expands over the barded portion 254 and is secured in place.

When the peristaltic pump 108 pumps the first beverage ingredient 106, the inner diameter of the first fluid conduit 104 may be configured to expand about the head portion 256 to enable the first beverage ingredient 106 to pass into the opening 252. When the peristaltic pump 108 stops pumping the first beverage ingredient 106, the inner diameter of the first fluid conduit 104 may be configured to contract about the head portion 256 to create a seal which prevents backflow. Other types of check valve configurations are possible, including, but not limited to, duckbill valves, ball valves, etc. Any valve configuration capable of preventing backflow can be used herein. Preventing backflow to the container 102 may maintain the aseptic nature of the first beverage ingredient 106 disposed within the container 102. In some instances, the first inlet 210 may not include a check valve. For example, a check valve may be disposed upstream of the first inlet 210.

The first inlet 210 may include a lip 258. The lip 258 may be configured to mate with a slot 260 in the house 202. The slot 260 may be disposed adjacent to the aperture 241 in the top ring 240. For example, the slot 260 may be formed between the circular rim 244 and a shoulder 261. In this manner, the lip 258 of the first inlet 210 may be slid into the slot 260 so as to position the first inlet 210 about the aperture 241 in the top ring 240. In some instances, the lip 258 may include a bulge 262 extending therefrom. The bulge 262 may seat within the aperture 241 to form a seal therebetween. In this manner, the first inlet 210 may be easily removed, replaced, and/or swapped out with other types of inlets.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A beverage nozzle for mixing at least a first beverage ingredient and a second beverage ingredient into a homogeneous mixture, the beverage nozzle comprising:

a housing comprising a first portion and a second portion;

a first inlet in fluid communication with the housing, wherein the first inlet is configured to provide the first beverage ingredient to the housing, wherein the first inlet is removable;

a second inlet in fluid communication with the housing, wherein the second inlet is configured to provide the second beverage ingredient to the housing, wherein the second inlet is removable;

a mixing core disposed within the housing, wherein the mixing core is configured to mix the first beverage ingredient and the second beverage ingredient into the homogeneous mixture;

an outlet disposed about the housing, wherein the homogeneous mixture exits the housing by way of the outlet; and a top ring attached to the second inlet, wherein the top ring comprises an aperture therethrough, wherein the first inlet comprises an opening and a lip, the lip configured to slide into a slot in the housing to position the first inlet adjacent to the top ring, and align the top ring aperture with the first inlet opening.

2. The beverage nozzle of claim 1, wherein the second inlet comprises a first groove configured to mate with a first rim formed between the first and second portions of the housing.

3. The beverage nozzle of claim 2, wherein the top ring comprises a second groove disposed around the aperture, wherein the second groove is configured to mate with a second rim formed between the first and second portions of the housing, wherein the first groove and first rim are traverse to the second groove and the second rim.

4. The beverage nozzle of claim 3, wherein the lip comprises a bulge extending therefrom that is configured to seat within the aperture to form a seal therebetween.

5. The beverage nozzle of claim 1, further comprising one or more additional inlets in fluid communication with the housing, wherein the one or more additional inlets are configured to provide one or more flavors, vitamins, or additional beverage ingredients to the housing.

6. The beverage nozzle of claim 1, wherein the first portion comprises an upper portion, wherein the second portion comprises a lower portion, wherein the first inlet and the second inlet are disposed about the upper portion.

7. The beverage nozzle of claim 1, wherein the first portion of the housing and the second portion of the housing are configured to be attached to each other.

8. The beverage nozzle of claim 1, further comprising one or more ribs disposed about the outlet, wherein the one or more ribs are configured to provide a laminar flow to the homogeneous mixture at the outlet.

9. The beverage nozzle of claim 1, wherein the mixing core is removable from the housing such that it is interchangeable with other mixing cores.

10. The beverage nozzle of claim 1, wherein the mixing core is integral with the housing.

11. The beverage nozzle of claim 1, wherein the mixing core is configured to create at least one of a turbulent flow, a laminar flow, or various combinations thereof within the housing.

12. The beverage nozzle of claim 1, wherein a mixing characteristic of the mixing core is dependent on a composition of at least one of the first beverage ingredient or the second beverage ingredient.

13. The beverage nozzle of claim 1, wherein at least a portion of the mixing core or the housing is textured or smooth.

14. The beverage nozzle of claim 1, wherein the housing comprises an elongated internal chamber, and wherein the mixing core comprises an elongated structure configured disposed within at least a portion of the elongated internal chamber.

15. The beverage nozzle of claim 1, wherein the first inlet comprises a check valve, and wherein the first inlet is in communication with a peristaltic pump configured to provide the first beverage ingredient to the first inlet.

16. The beverage nozzle of claim 1, further comprising a flow valve upstream of the second inlet, wherein the second inlet comprises a nozzle, and wherein the second inlet is in communication with a water source.

17. The beverage nozzle of claim 1, wherein the second inlet is angled towards the first inlet, or wherein the first inlet is transverse to the second inlet.

18. The beverage nozzle of claim 1, further comprising a headspace formed within an upper portion of the housing between an internal surface of the upper portion of the housing and the mixing core, wherein the first inlet and the second inlet are disposed about headspace, and wherein an internal surface within the upper portion of the housing is curved.

* * * * *